US010513111B2

(12) United States Patent
Lahiri et al.

(10) Patent No.: US 10,513,111 B2
(45) Date of Patent: Dec. 24, 2019

(54) ACTUATOR DRIVE CIRCUIT WITH TRIM CONTROL OF PULSE SHAPE

(71) Applicant: Xaar Technology Limited, Cambridge (GB)

(72) Inventors: Anirban Lahiri, St Ives (GB); Mujahid-ul Islam, Griton (GB); Mario Massucci, Cambridge (GB); Ian Anthony Hurst, Cambridge (GB); Stephen Mark Jeapes, Cambridge (GB); Neil Christopher Bird, Cambridge (GB); Anthony Saugey, Nogent sur Marne (FR)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 15/557,088

(22) PCT Filed: Jan. 29, 2016

(86) PCT No.: PCT/GB2016/050194
§ 371 (c)(1),
(2) Date: Sep. 9, 2017

(87) PCT Pub. No.: WO2016/142645
PCT Pub. Date: Sep. 15, 2016

(65) Prior Publication Data

US 2018/0056648 A1 Mar. 1, 2018

(30) Foreign Application Priority Data

Mar. 11, 2015 (GB) ..... 1504108.0

(51) Int. Cl.
*B41J 2/045* (2006.01)

(52) U.S. Cl.
CPC ..... *B41J 2/04541* (2013.01); *B41J 2/0459* (2013.01); *B41J 2/04515* (2013.01);
(Continued)

(58) Field of Classification Search
CPC ..... B41J 2/04588
See application file for complete search history.

(56) References Cited

U.S. PATENT DOCUMENTS 5,124,716 A 6/1992 Roy et al.
5,502,468 A 3/1996 Knierim
(Continued)

FOREIGN PATENT DOCUMENTS

EP 0816081 A2 1/1998
EP 0876915 A2 11/1998
(Continued)

OTHER PUBLICATIONS

UKIPO Examination Report; GB 15 04108.0; dated Mar. 9, 2017.
(Continued)

*Primary Examiner* — Shelby L Fidler
(74) *Attorney, Agent, or Firm* — Finnegan, Henderson, Farabow, Garrett & Dunner, LLP

(57) ABSTRACT

A drive circuit (100) for driving actuators of a printhead (97) from a common drive waveform has a switching circuit (32) for coupling the common drive waveform to an actuator (1,2), and a timing circuit (10) to control the switching circuit to form a drive pulse from the common drive waveform. The drive pulse is trimmed by controlling a duration (TTRIM) of a step at an intermediate level (VHOLD) in the drive pulse. This can improve the trade-off between available range of trimming and thermal efficiency because the voltage drop across the switching circuit can be reduced, compared to trimming only the height. Decoupling during a flat portion of the common drive waveform can enable the
(Continued)

FIGURE 6 timing of the decoupling to be more relaxed compared to decoupling during a slope. Such relaxing can enable costs, complexity and thermal loading to be reduced.

17 Claims, 14 Drawing Sheets

(52) U.S. Cl.
CPC ..... *B41J 2/04573* (2013.01); *B41J 2/04581* (2013.01); *B41J 2/04586* (2013.01); *B41J 2/04588* (2013.01)

(56) References Cited

U.S. PATENT DOCUMENTS 5,541,628 A 7/1996 Chang et al.
6,092,886 A 7/2000 Hosono
6,149,258 A 11/2000 Kimura
6,161,912 A 12/2000 Kitahara et al.
6,312,076 B1 11/2001 Taki et al.
6,312,077 B1 11/2001 Araki
6,328,397 B1 12/2001 Shimizu et al.
6,488,349 B1 * 12/2002 Matsuo ..... B41J 2/04581 347/11
6,685,293 B2 2/2004 Junhua
6,837,561 B2 1/2005 Yazdy
6,923,520 B2 8/2005 Oikawa et al.
7,073,878 B2 7/2006 Nishida et al.
7,252,355 B2 8/2007 Umeda
7,390,070 B2 6/2008 Hiwada et al.
7,549,716 B2 6/2009 Kida et al.
7,625,056 B2 12/2009 Fukano et al.
7,673,953 B2 3/2010 Yamashita
7,722,142 B2 5/2010 Hiwada et al.
7,871,141 B2 1/2011 Teramae
7,934,786 B2 5/2011 Ozawa
8,303,067 B2 11/2012 Kitaoka
8,313,160 B2 11/2012 Matsuo
8,313,170 B2 11/2012 Tabata et al.
8,434,842 B2 5/2013 Matsuo
8,449,057 B2 5/2013 Matsuo
8,899,711 B2 12/2014 Masuda et al.
9,016,816 B2 4/2015 Terayama et al.
9,022,498 B2 5/2015 Otsuka et al.
2002/0018085 A1 * 2/2002 Asauchi ..... B41J 2/04541 347/10
2003/0085962 A1 * 5/2003 Junhua ..... B41J 2/04581 347/68
2004/0051817 A1 * 3/2004 Takahashi ..... B41J 2/0456 349/1
2005/0200639 A1 9/2005 Kobayashi et al.
2006/0098036 A1 * 5/2006 Gardner ..... B41J 2/04581 347/10
2007/0002091 A1 1/2007 Kida et al.
2007/0076022 A1 * 4/2007 Takizawa ..... B41J 2/04505 347/5
2009/0278877 A1 11/2009 Kimura et al.
2009/0289975 A1 11/2009 Yoshida
2010/0220134 A1 * 9/2010 Matsushita ..... B41J 2/04581 347/10
2011/0090272 A1 4/2011 Matsuo
2011/0122182 A1 5/2011 Hoisington
2011/0128317 A1 6/2011 Oshima et al.
2011/0316915 A1 12/2011 Matsushita
2012/0007906 A1 * 1/2012 Zhang ..... B41J 2/04553 347/14
2012/0262512 A1 * 10/2012 Oshima ..... B41J 2/04541 347/10
2014/0210884 A1 * 7/2014 Rosario ..... B41J 2/04588 347/10
2015/0035885 A1 2/2015 Fukuda
2015/0042710 A1 2/2015 Rukuda
2018/0111369 A1 * 4/2018 Van Der Heyden ..... B41J 2/04588

FOREIGN PATENT DOCUMENTS

EP 1285759 B1 3/2006
EP 2839958 B1 5/2016
EP 2839959 B1 6/2016
EP 3041682 A1 7/2016
GB 2530976 A 4/2016
JP 2010179585 A 8/2010
JP 2013056453 A 3/2013
JP 2014111314 A 6/2014
JP 2014144546 A 8/2014
JP 5672337 B2 2/2015
WO WO 2013162537 A1 10/2013

OTHER PUBLICATIONS

PCT International Search Report and Written Opinion; PCT/GB2016/050194; dated Apr. 28, 2016.
UKIPO Search and Examination Report; GB 15 04108.0; dated Sep. 11, 2015.
Chinese First Office Action, in corresponding Chinese Application No. 201680013020.X, 6 pages, and machine translation (10 pages).

* cited by examiner

FIGURE 4
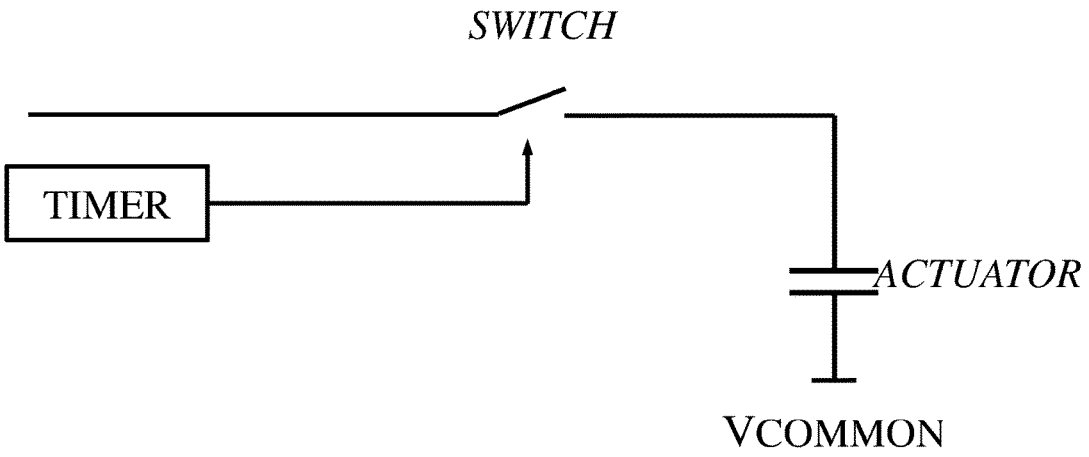
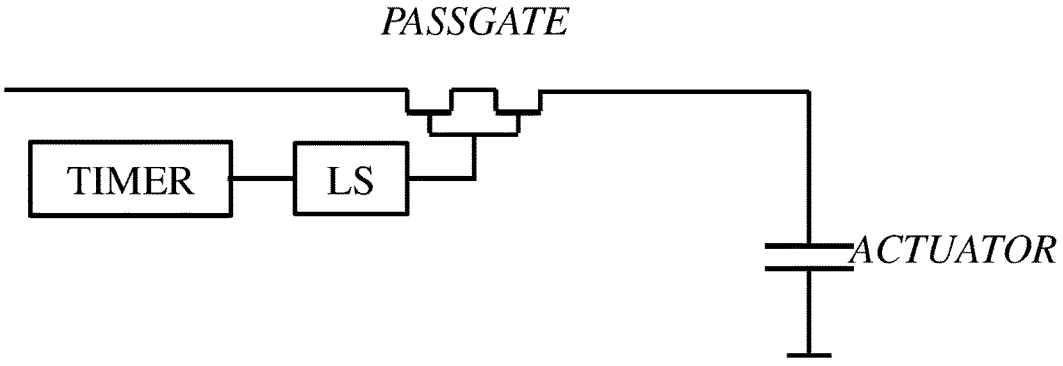
FIGURE 5

PASSGATE:
M1 = LARGE W/L
M2A = SMALL W/L
M2B = LARGE W/L

ACTUATOR DRIVE CIRCUIT WITH TRIM CONTROL OF PULSE SHAPE

FIELD OF THE INVENTION

The present invention relates to drive circuits for driving a plurality of actuators of printheads, to printhead circuits having such drive circuits and to printhead assemblies having such printhead circuits and to corresponding methods.

BACKGROUND

It is known to provide printhead circuits for printers such as inkjet printers. For example, the inkjet industry has been working on how to drive piezoelectric printhead actuators for more than fifty years. Multiple drive methods have been produced and there are multiple different types in use today, some are briefly discussed now.

Hot Switch: This is the class of driving methods in which the generation of drive waveforms for the actuators takes place within the print head itself. Typically, the electronics in the print head are implemented in an integrated circuit (ASIC). In this approach, all of the power dissipation associated with generating the waveforms and connecting them to the actuators (a total of 0.5 $CV^2$ per driven actuator) occurs in the print head. This was the original drive method, before cold switch became popular.

Cold Switch: This describes an alternative structure using a Common Drive Waveform (CDW). in which the electronics that generate the CDW is located outside of the print head. The electronics within the print head (typically an ASIC) is then only required to provide multiplexer functionality to connect this externally generated CDW to the appropriate actuator nozzles. A key advantage of this approach is that a significant proportion, in some cases perhaps around 80%, of the 0.5 $CV^2$ energy dissipation occurs in the external waveform generation electronics and, consequently, the dissipation in the print head and the ASIC is reduced. This makes it much easier to maintain the print head at or around a suitable operating temperature.

However, for printed image quality reasons, it is highly desirable to provide a mechanism for trimming the drop velocity or drop volume on a per actuator nozzle basis. This requires that the drive circuits are capable of generating an individually-tailored waveform to each actuator nozzle. In a hot switching environment, in which the waveforms are generated in the print head itself (typically in an ASIC) this is straightforward to achieve. In a cold switching environment, however, where a common drive waveform (CDW) is generated outside of the print head, the modification of the waveform on a per actuator nozzle basis is more difficult to achieve.

US 2005200639 shows a printer with drive circuitry for actuators using a common drive waveform applied to one side of the actuators and with switches for coupling the other side of the actuators to a common return path. The switches are controlled to switch on sloping edges of pulses of the common drive waveform to adjust a height of the pulses, for an array of actuators. Adjustments can be made for each printed line so that blocks can be varied around an average weighting.

U.S. Pat. No. 8,303,067 shows a stepped common drive waveform with multiple different pulses having multiple levels, switching is carried out to select which of the different pulses to use to generate different sizes of droplet.

There is adjustment of ejection speed by widening or narrowing intervals between successive droplets.

US 2009/0278877 shows common drive waveforms A and B with multiple levels, with adjustment of h1, a hold time when the chamber is at maximum volume before contraction and ejection.

US 2011/0128317 shows a common drive waveform and adjustment of timing of gating during a ramp so as to change a height of the ramp.

US20120262512 shows a common drive waveform and shows changing a height of part of a pulse by controlling a timing of a switch to couple the common drive waveform to an actuator, to compensate for variations between different actuators.

SUMMARY

Embodiments of the invention can provide improved apparatus or methods or computer programs. According to a first aspect of the invention, there is provided a drive circuit for driving at least one of a plurality of actuators of a printhead from a common drive waveform, and having a switching circuit for coupling the common drive waveform to provide a drive pulse to a selected at least one of the actuators, and a timing circuit coupled to receive a trimming signal and having a control output coupled to control the switching circuit so as to form the drive pulse from at least part of a pulse in the common drive waveform, and so as to trim the drive pulse by controlling according to the trimming signal a duration of a step at an intermediate level in the drive pulse.

Any additional features can be added to any of the aspects, or disclaimed, and some such additional features are described and some set out in dependent claims. One such additional feature is the timing circuit being arranged to control the duration of the step by causing the switching circuit to couple the common drive voltage to the selected at least one of the actuators to provide a transition in the drive pulse, to decouple for a period to provide a flat portion of the step, and to recouple the common drive waveform to the selected at least one of the actuators to provide another transition of the same drive pulse.

Another such additional feature is the switching circuit also having a circuit to selectively couple the selected at least one of the actuators to a reference voltage, and the timing circuit being arranged to control the duration by causing the switching circuit to couple the common drive voltage to the selected at least one of the actuators to provide a transition in the drive pulse, and to couple the reference voltage to the selected at least one of the actuators for a period of the same drive pulse to provide a flat portion of the step.

Another such additional feature is the timing circuit being configured to control the duration of the step independently of control of a height of the step. Another such additional feature is the timing circuit being arranged to change a state of the switching circuit during a flat portion of the common drive waveform. Another such additional feature is the drive circuit being arranged so that, where the common drive waveform comprises a multilevel pulse having a portion at the intermediate level before a portion at another level, the timing circuit is arranged to cause decoupling from the common drive waveform to occur during the portion at the intermediate level and to cause a recoupling to occur during the portion at the another level, to control the duration of the step. Another such additional feature is the drive circuit being arranged so that where the common drive waveform comprises a multilevel pulse having a portion at another level before a portion at the intermediate level, the timing circuit is arranged to cause decoupling from the common drive waveform to occur during the portion at the another level and to cause a recoupling to occur during the portion at the intermediate level to control the duration of the step.

Another such additional feature is the switching circuit being arranged to cause a transition in the step of the drive pulse where it does not follow the common drive waveform, to have a different slew rate to that of a transition in the common drive waveform. Another such additional feature is the switching circuit having at least two separately controllable switching paths having different series resistances, and the timing circuit being arranged to control the switching paths to provide a higher series resistance during the transition. Another such additional feature is the timing circuit being arranged to receive a reference timing signal, and to receive the trimming signal as a digital value corresponding to a time interval between the reference timing signal and a desired timing of the step, and having a digital circuit for using the digital value and the reference timing signal to generate the control output.

Another such additional feature is the drive circuit being arranged such that when the common drive waveform has no step at the intermediate level, the timing circuit is arranged to change the switching circuit as the common drive waveform passes through the intermediate level. Another such additional feature is the switching circuit having a holding circuit for maintaining a level in the drive pulse without isolating it from the common drive waveform.

Another aspect provides a printhead assembly having at least one drive circuit for driving at least one of a plurality of actuators of a printhead from a common drive waveform, and a common drive waveform circuit for generating the common drive waveform with a pulse having a flat portion. The drive circuit has a switching circuit for coupling the common drive waveform to provide a drive pulse to a selected at least one of the actuators, and a timing circuit coupled to receive a trimming signal and having a control output coupled to control the switching circuit so as to form the drive pulse from at least part of the pulse in the common drive waveform, and so as to trim the drive pulse by controlling according to the trimming signal a duration of a step in the drive pulse, by changing a state of the switching circuit during the flat portion in the common drive waveform. Another such additional feature is the common drive waveform circuit having a level adjustment circuit for adjusting the intermediate level. The printhead assembly can have a drive circuit with any of the additional features set out above.

Another aspect provides a printer having a printhead assembly having any of the drive circuits set out above.

Another aspect provides a method of operating a printhead having a plurality of actuators, having the steps of: using a switching circuit for coupling a common drive waveform having a pulse, to a selected at least one of the actuators to provide a drive pulse, generating a trimming signal and controlling the switching circuit to form the drive pulse from at least part of a pulse in the common drive waveform. The drive pulse is trimmed by controlling according to the trimming signal a duration of a step at an intermediate level in the drive pulse.

Numerous other variations and modifications can be made without departing from the claims of the present invention. Therefore, it should be clearly understood that the form of the present embodiments of the invention is illustrative only and is not intended to limit the scope of the present invention.

BRIEF DESCRIPTION OF THE DRAWINGS

How the present invention may be put into effect will now be described by way of example with reference to the appended drawings, in which:

FIGS. 4 and 5 show switching circuits according to embodiments.

DETAILED DESCRIPTION

Figure 1:
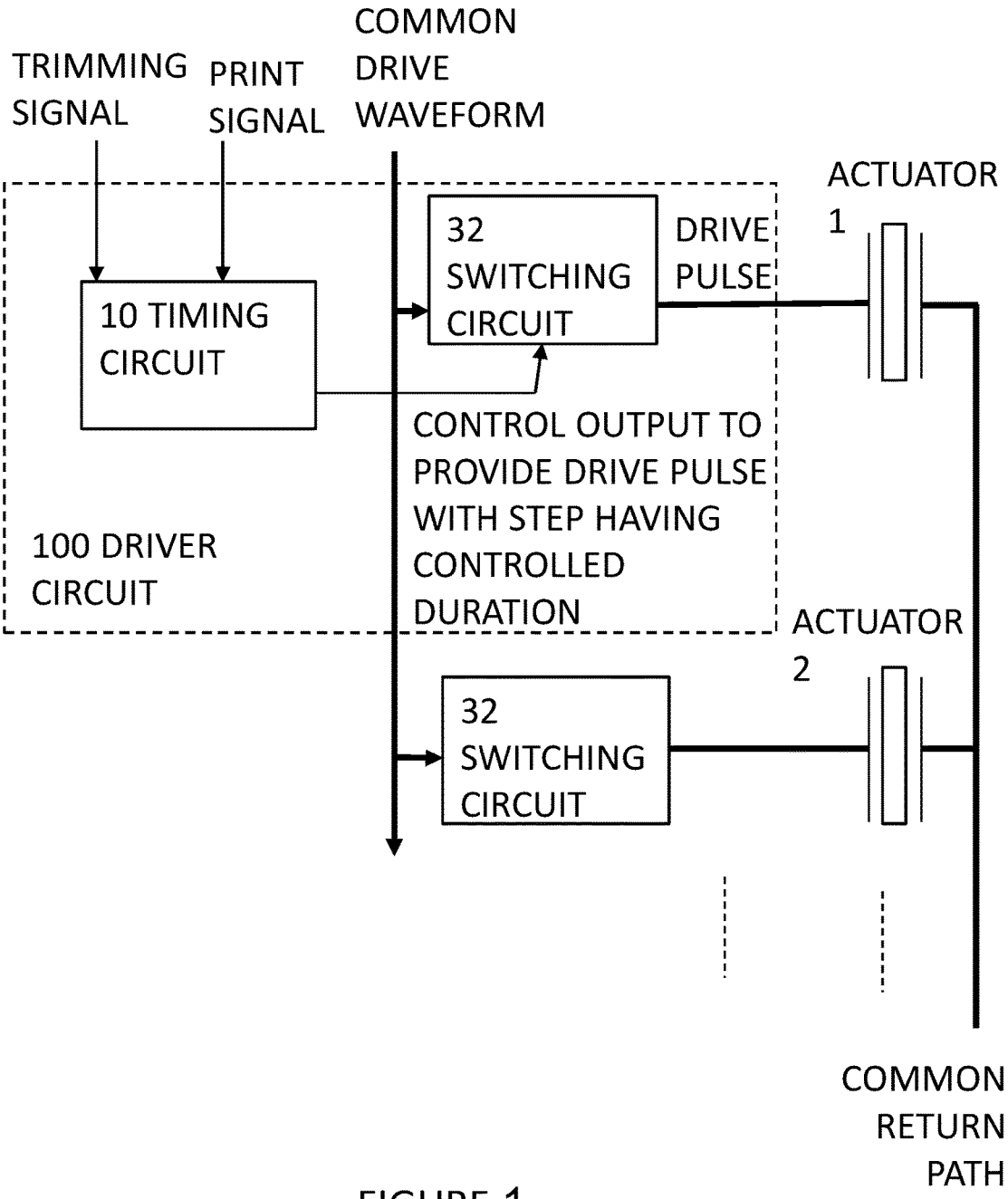
FIG. 1 shows a schematic view of a drive circuit according to an embodiment.

The present invention will be described with respect to particular embodiments and with reference to drawings but note that the invention is not limited to features described, but only by the claims. The drawings described are only schematic and are non-limiting. In the drawings, the size of some of the elements may be exaggerated and not drawn to scale for illustrative purposes.

Definitions

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

References to programs or software can encompass any type of programs in any language executable directly or indirectly on any computer.

References to circuits or circuitry or logic or processor or computer, unless otherwise indicated are intended to encompass any kind of processing hardware which can be implemented in any kind of logic or analog circuitry, integrated to any degree, and not limited to general purpose processors, digital signal processors, ASICs, FPGAs (Field Programmable Gate Arrays), discrete components or logic and so on, and are intended to encompass implementations using multiple processors which may be integrated together, or co-located or distributed at different locations for example.

References to nozzles are intended to encompass any kind of nozzle for ejecting any kind of fluid from a fluid reservoir for printing 2D images or 3D objects for example, onto any kind of media, the nozzles having actuators for causing the ejection in response to an applied electrical voltage or current.

References to actuators are intended to encompass any kind of actuator for such nozzles, including but not limited to piezoelectric actuators, provided they have a predominantly capacitive characteristic, so that the voltage across it does not change significantly when it is decoupled from the CDW during the step in the pulse.

References to groups or banks of the actuators or nozzles are intended to encompass linear arrays of neighbouring nozzles, or 2-dimensional rectangles or other patterns of neighbouring nozzles, or any pattern or arrangement, regular or irregular or random, of neighbouring or non-neighbouring nozzles.

References to a step in a pulse are intended to encompass any kind of notch or protrusion in the typically trapezoidal shaped pulse including and not limited to those having one or more flat portions each next to a sloping portion, sloping up or down, and the flat portion may be flat or have a small gradient less than a gradient of the sloping portion.

References to level are intended as encompassing a portion of a pulse, such as a step, or shelf or a flat or sloping part with a shallower gradient than edges of the pulse.

References to decouple are intended to encompass switching to isolate from a drive circuit, or if not isolating, then applying holding circuit to hold the voltage against being changed by the drive circuit, such as applying a relatively large capacitor or a voltage supply circuit to hold the voltage temporarily without isolating.

An actuator's motion creates the pressure and flow that pushes fluid through the nozzle. The performance of each nozzle is characterized mostly by the drop speed, drop weight, appearance of satellites, and drop shape. Variability in actuator motion can cause errors and artefacts in the image quality during printing. Sources of the variability can be due to manufacturing variability or due to the operating environment; for example, the frequency at which an actuator is fired affects the drop speed. It is desirable to be able to control individual actuators to allow the printing system to compensate for these effects.

Effects to be compensated for can include for example:

Firing frequency (same actuator)

Historic firing (same actuator)

Crosstalk from actuators in close proximity (due to electrical, fluidic and mechanical interference)

Ambient temperature and ink temperature,

Aging of piezoelectric material/MEMS structures

Manufacturing variance

Existing printhead circuits such as hot switch or cold switch drive ASICs for driving print actuators have limitations in terms of their cost and power dissipation for compensation of the above effects. So there is a question of how to provide electrical drive for actuators such as piezoelectric actuators at the lowest circuit area (to reduce the cost) and with the lowest power dissipation, which reduces thermal effects, while still meeting minimum drive requirements. Using hot switch methods that vary the pulse width of the drive pulse to each actuator or vary the voltage level at each pulse has a large thermal impact. All of the drive power plus baseline power is dissipated in the ASIC which is located within the printhead close to the actuators and there tend be larger areas for these designs, meaning added costs in the ASIC. In cold switch designs, on the other hand, the majority of the power dissipation occurs in the circuitry creating the CDW which is located outside the printhead and much easier to cool than an ASIC inside the printhead.

Jetting performance, specifically the volume and velocity of ejected drops, of the individual actuators/nozzles on for example a MEMS printhead can vary as a result of manufacturing tolerances. In addition, the drop ejection velocity or drop shape or volume can be influenced by the jetting of adjacent nozzles (crosstalk) and, in cases where high frequency jetting is required, is also influenced by the time elapsed since the actuator under consideration itself last ejected a drop of ink. Compensating for these variations and effects requires a mechanism in which the drop ejection velocity can be trimmed on a per-nozzle and in some cases per-ejection basis. If such a mechanism can be successfully implemented, image artefacts that would result from differences in droplet ejection velocity between nozzles can in principle be corrected.

One current method for providing a trimming mechanism is based on changing the amplitude of the trapezoidal waveform applied to individual actuator channels. The droplet velocity (and also droplet volume) is a function of the waveform amplitude and therefore, by changing this, the droplet velocity can be trimmed. But implementing this "voltage trimming" approach in a cold switching environment is difficult without using excessive silicon area and increasing the power consumption of the ASIC, thus losing the thermal advantages of the cold switching approach. The description below of embodiments of the present invention shows various ways to provide generation of individually tailored waveforms for the actuator nozzles in a cold-switching environment where the additional heat dissipated by the circuits that modify the CDW can be reduced or minimised.

Embodiments as described below provide for trimming to vary the resulting droplet by controlling a duration of the proposed step in the drive pulse. Various implementations are possible. Some are based on perturbing the slew rate of the leading or the trailing edge of the pulse in the Common Drive Waveform (CDW) so that the drive pulse does not follow that edge of the CDW, by isolating or forcing or holding the voltage, to provide the step in the drive pulse for the trimming function rather than producing the step by providing a ledge in the common drive waveform. Some of the proposed implementations involve a holding circuit to create the step, though some implementations of this use an on-ASIC capacitance per nozzle, which has disadvantages in terms of amount of silicon area used. Some implementations cause the switch to decouple the drive pulse from the CDW during a flat portion in the CDW. This enables the timing precision of the decoupling to be more relaxed than if the decoupling takes place during a sloping portion since the slope makes the level of the intermediate level very sensitive to the precise timing of the decoupling.

Trimming may be effected by varying the height of the step (shown in the Figures as the $V_{HOLD}$ voltage, or the difference between the intermediate level and another level) as well as the duration of the step. Thermally it is usually more efficient if the duration is controlled independently of the height of the step so that the height ($V_{HOLD}$) can be reduced as far as possible which means the trimming is done mostly or completely by controlling the duration of the step. Increasing the duration of the step reduces the area of the drive pulse and thus reduces drop velocity. Some of the thermal effects of a lower height step are explained briefly now. To create the end of the flat portion of the step, the switching circuit turns ON and the actuator voltage is recoupled to the CDW voltage, which in a typical example, is now at ground. This transition is a hot switching type, with the power dissipation being proportional to the square of the voltage, and taking place in the printhead, hence the preference to use as low a height of step ($V_{HOLD}$) as possible.

To avoid a high peak current which can cause voltage disturbance on the ground resulting from parasitic resistance and inductance effects, a 'high resistance' switch can be used to reduce a slew rate. This can be implemented in various ways, for example by using a separate MOS transistor or by having a transistor with multiple separately controllable gate fingers having different resistances. The trimming signal can be loaded as a digital value to give dynamic trimming.

Some consequences of particular embodiments are as follows.

1. Simpler circuitry is possible having little silicon real estate overhead (e.g. in an ASIC implementation), especially for cases where the timing of decoupling is less critical, in simpler embodiments only the addition of 1 timer and 1 level shifter per channel in the ASIC is used.

2. The trimming range and resolution can be adjusted by control of the CDW (by changing the height of the voltage ledge in the CDW).

3. The trimming range and thermal dissipation trade-off can likewise be changed by changing the ledge voltage in the CDW.

4. Some implementations may have a fast slew rate of the hot-switch part of the drive pulse where it has a transition which does not follow the CDW. The fast slew rate can be reduced by increasing the resistance of the switch i.e. by using a separate smaller switch or by using a part of the right hand side portion of the switch e.g. one or two fingers of the right hand side transistor only. The lower slew rate can reduce the high peak currents and thus reduce ground or voltage rail spikes.

5. The trimming concept is a step based trimming, overall this class of driver is a hybrid hot/cold switch type. For instance, in one embodiment, on the trailing edge of the waveform (the second or rising edge) all the energy into the load is provided by a cold switch multiplexer, whereas on the first (i.e. falling or leading) edge, all of the driving energy is provided by a cold switch multiplexer up to the ledge voltage, but with a hot switch transistor for driving from the ledge voltage back to the waveform (now at zero) after a programmed delay. This is because on the falling edge and first part of the leading edge, the CDW generating circuit is controlling the maximum slew rate. The transition from the ledge voltage back to the waveform is controlled by the RC time constant formed by the pass gate switch ON resistance and the load capacitance, and is therefore a hot transition. The net result is still a driver that has lower thermal impact than a hot switch design.

Figure 2:
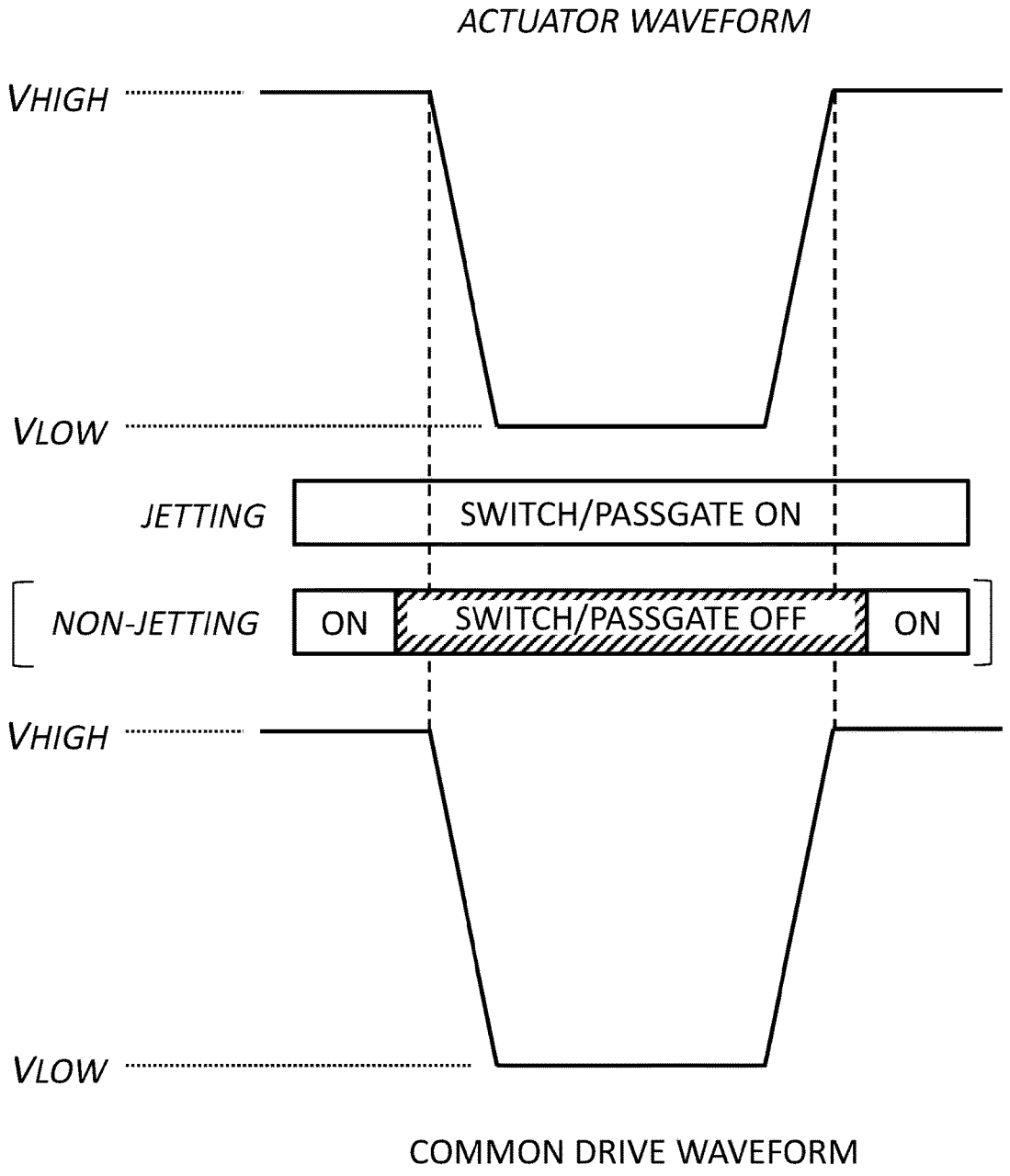
FIG. 2 shows a timing diagram without a step for comparison with embodiments.
Figure 3:
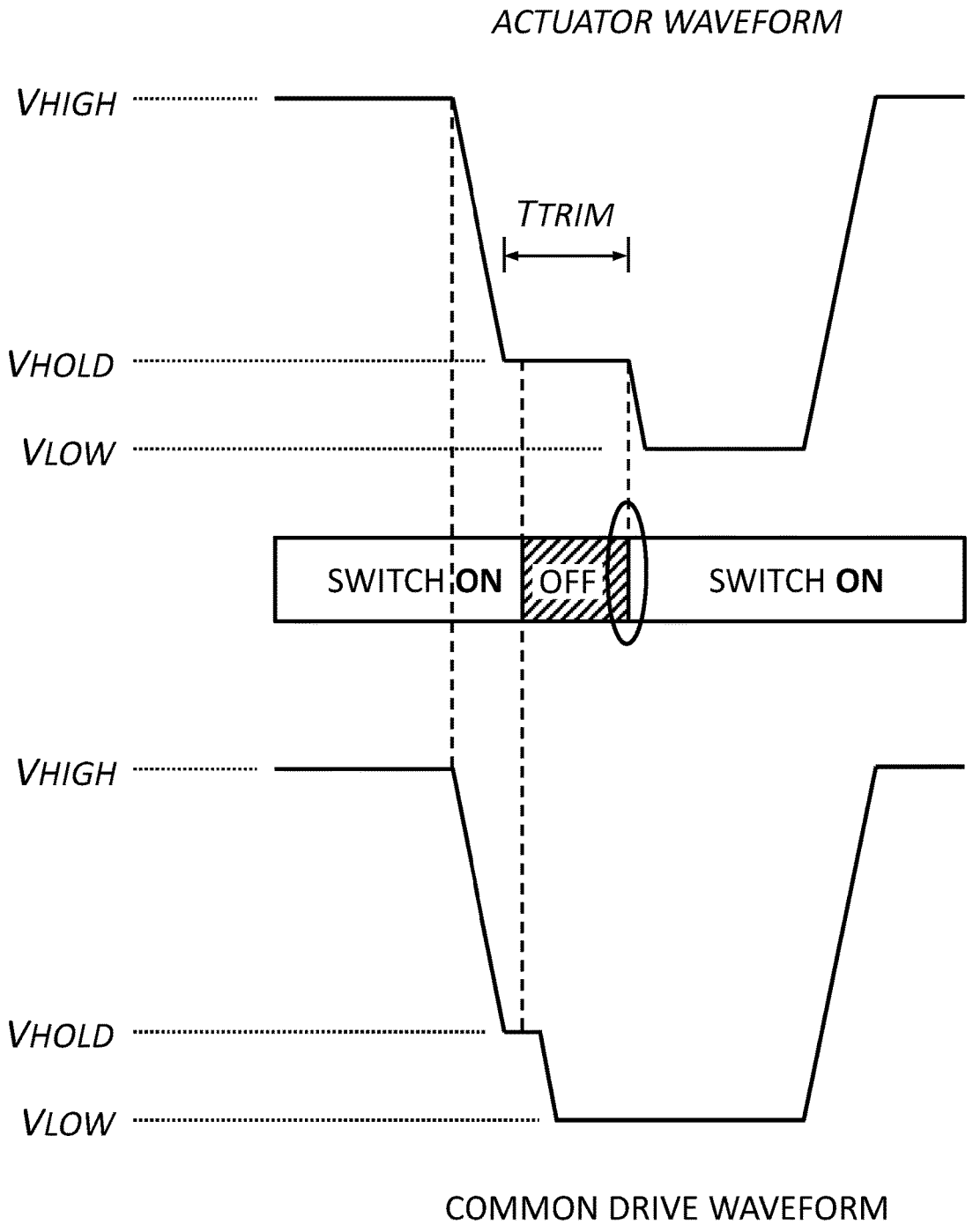
FIG. 3 shows a timing diagram according to an embodiment.

FIGS. 1-3: Printhead Assembly Having a Drive Circuit According to an Embodiment FIG. 1 shows a schematic view of apparatus according to an embodiment, in the form of circuitry for use on a printhead for providing ejection pulses for driving a plurality of actuating elements 1, 2 from a CDW. An example of the CDW is shown in FIG. 3, which shows notably a step in the drive pulse. The drive circuit 100 has a switching circuit 32 for coupling a selected one of (or a bank of) the actuating elements to the CDW, and a timing circuit 10 for controlling the switching circuit. The timing circuit is coupled to receive a trimming signal and a print signal at least. The timing circuit is configured to open the first switching circuit to decouple the CDW from the respective actuating element at least part way along a pulse in the CDW, and to form a drive pulse having a step having a duration controlled according to the trimming signal. The CDW is also coupled to other switching circuits for other actuators 2. FIG. 2 shows a timing diagram for a basic implementation of a trimming scheme before modification by inclusion of a step, for comparison with embodiments described below. The Figure shows a CDW at the bottom, a resulting drive pulse applied to the actuator is shown by the top line of the diagram, and a state of the switch for coupling the actuator to the CDW is indicated in the horizontal bars between the two waveforms. These bars show that for the jetting case the print signal is ON and the switching circuit is ON throughout the pulse in the CDW, and for the non-jetting case the print signal is OFF and the switching circuit is OFF for the entire duration of the pulse.

The print signal input to the timing circuit is provided so that the switching circuit can cause the actuator to be decoupled for the duration of the cycle of the waveform so that no drive pulse is produced for a given pixel of an image if the print signal indicates that there is no dot to be printed for that pixel. There are many ways to generate the timing to control the duration, synchronised to an internal clock or to a level or slope of the CDW or to some timing reference for example.

To compensate for differences between actuating elements, and/or in some cases to compensate for parameters varying over time such as temperature, ageing or crosstalk from neighbouring pixels, a trimming signal is applied as necessary for each actuator to modify the CDW. The trimming signal can be generated for example from a look up table, or by a processor based on measurements of output or temperature for example, or from information such as manufacturing calibration results, or print image information for example, or a combination.

FIG. 3 shows a timing diagram for a basic implementation of a step-based trimming scheme according to an embodiment. The CDW has a pulse which may have any shape, and is shown at the bottom of the diagram. The resulting drive pulse applied to the actuator is shown by the top line of the diagram. A notable feature is the step in the leading edge of the actuator waveform, the step being at an intermediate voltage $V_{HOLD}$ and a duration $T_{TRIM}$. Timing of the switching is indicated in the horizontal bar between the two waveforms. This bar has a switch ON section during most of the leading edge of the pulse in the CDW. Next is an OFF section shown in hashing which means the actuator is decoupled and so the step in the drive pulse is prolonged and does not end at the end of the ledge in the CDW. Next is a switch ON section which means the actuator is again coupled to the CDW. The start of this section causes the end of the step in the drive pulse, and the voltage drops from the intermediate level, $V_{HOLD}$, down to follow the voltage $V_{LOW}$ of the bottom of the pulse in the CDW. This differs from FIG. 2 by the step in the drive pulse, and in that in FIG. 3 for the jetting case the print signal can be ON throughout the pulse but the switching circuit is OFF for part of the step in the pulse. For the non jetting case where the print signal is OFF for the entire duration of the pulse, although not shown in FIG. 3, the switching circuit state would be OFF for the entire duration of the pulse, which is the same as shown in FIG. 2.

FIG. 3: Operation

A more detailed explanation of the operation of the example of FIG. 3 is as follows:

1. Prior to the leading edge of the CDW, the switch is turned ON (if not ON already). The leading edge of the CDW is coupled via the switch to the actuator.

2. When the CDW voltage reaches $V_{HOLD}$, it remains at that voltage for a short period, forming a ledge in the CDW. This period may for example be 0.1 μs to 0.5 μs, typically/preferably about 0.25 μs. While the CDW voltage is at $V_{HOLD}$, the switch turns OFF which isolates the actuator from the CDW; and the actuator voltage remains at $V_{HOLD}$.

3. After the short period of e.g. 0.1 μs to 0.5 μs, the CDW continues down to $V_{LOW}$.

4. Meanwhile with the switch off, the actuator remains at $V_{HOLD}$ until a duration, $T_{TRIM}$, has passed and the switch turns ON and the voltage applied to the actuator becomes $V_{LOW}$.

5. The actuation activity is then completed by the CDW slewing back to $V_{HIGH}$. During this transition, the actuator voltage follows the CDW because the switch is turned on.

Note that:

a). The duration of the step, $T_{TRIM}$, in the actuator voltage, and hence the amount of trimming, is determined by the timing of switch turning on, as highlighted in FIGS. 2 and 3 by an ellipse around the time of the change in switching.

b). The ledge on the leading edge of the CDW is optional but is useful for two reasons:

(i) it defines the $V_{HOLD}$ level for the step in the actuator waveform; and (ii) the required accuracy of the switch turn OFF event is determined by the duration of the ledge in the CDW waveform—the requirement being that the switch turns OFF while the CDW voltage is at $V_{HOLD}$. This is in contrast with an implementation which does not include a ledge in the CDW. In that case, the accuracy of the $V_{HOLD}$ level would be determined by the timing of the switch turn off. If the slew rate is 100V/μs (a typical value) then a $V_{HOLD}$ accuracy of 0.25V would require a switch turn off timing accuracy of 2.5 ns, which is not straightforward to achieve reliably.

c). The magnitude of the trimming effect is determined by both $T_{TRIM}$ and $V_{HOLD}$. This, then, gives the possibility of adjusting the trimming effect for a given $T_{TRIM}$ range. In operation, $V_{HOLD}$ could be set as low as possible, to reduce thermal dissipation, consistent with the range of trimming required. This allows the heat dissipated on the ASIC to be traded off with trimming range. $V_{HOLD}$ could be, say, in the range 10-25% of the way from $V_{LOW}$ to $V_{HIGH}$. $T_{TRIM}$ could be anything from zero to 100% of the width of the CDW pulse.

d). There can be many variants. The step can take various shapes, for example the flat portion forming the ledge can be sloping to some degree and still achieve much of the benefit. There can be multiple sub-steps within the step; the step can be on the leading edge or the trailing edge of the pulse, or on both edges, or away from either edge. There can be a series of steps within the pulse. The polarity of the pulse can be reversed, the slew rates of the edges can be limited, and the flat portions can be formed by coupling to a voltage reference or to a holding circuit such as a capacitor.

FIG. 1 thus shows an example of a drive circuit 100 for driving one of a plurality of actuators 1, 2, . . . of a printhead from a CDW, and having a switching circuit for coupling the CDW to provide a drive pulse to the selected actuator, and a timing circuit coupled to receive a trimming signal and having a control output coupled to control the switching circuit. This is arranged to operate as shown by example in FIG. 3 so as to form the drive pulse from at least part of a pulse in the CDW, and so as to trim the drive pulse by controlling according to the trimming signal a duration of a step at an intermediate level in the drive pulse. Optionally this control of duration can be carried out independently of control of the height of the step. The control of duration of the step changes the shape of the drive pulse which provides the trimming effect, rather than relying only on trimming a level in the drive pulse. The option of independent control of the duration enables the voltage drop across the switching circuit at the time of the step (a hot switch operation) to be reduced for a given range of trimming, compared to trimming only the level, or trimming both. This reduced voltage drop enables reduced dissipation which is particularly valuable where there are many actuators.

FIG. 3 is also an example of the operation of a timing circuit arranged to cause the switching circuit to decouple the CDW during a flat portion of the CDW. This can enable the timing of the change in coupling to be more relaxed since the resulting level is not so sensitive to the timing compared to the case that the decoupling occurs while the CDW is in transition through the intermediate level for example. Relaxing the precision of timing can enable cost, complexity and thermal loading to be reduced, or precision of trimming to be increased.

FIGS. 4 to 7: Switching Circuit Arrangements According to Embodiments

FIG. 4 shows a schematic view of an embodiment suitable to achieve the step of FIG. 3 in a simple way. The switching circuit comprises a switch 34 having open or closed states, to couple or decouple actuator 1 to or from the CDW. The state of the switch is controlled by the timing circuit 10 as described above. This is an example of the timing circuit being arranged to control the duration $T_{TRIM}$ by causing the switching circuit to couple the common drive voltage $V_{COMMON}$ to the selected at least one of the actuators to provide a transition in the drive pulse; to decouple for a period to provide a flat portion of the step; and to recouple the CDW to the selected at least one of the actuators to provide another transition of the same drive pulse. This is one way to implement the step in the drive pulse with relatively simple circuitry to keep costs and thermal effects low.

FIG. 5 shows an implementation of the switching circuit based on the use of a passgate 36. This is a known type of switching circuit, and timing of the passgate switching is controlled by the timing circuit 10 as described above. In this case the output of the timing circuit is voltage level shifted by the level shifter circuit LS to the voltage level required to switch the passgate to define the drive signal that reaches Actuator 1. This is a relatively simple implementation of the step-based trimming scheme, and can be based on use of a multilevel (e.g. three-level) CDW. It can be implemented at ASIC level with little modification compared to an ASIC which is not designed to support per-nozzle trimming.

Figure 6:
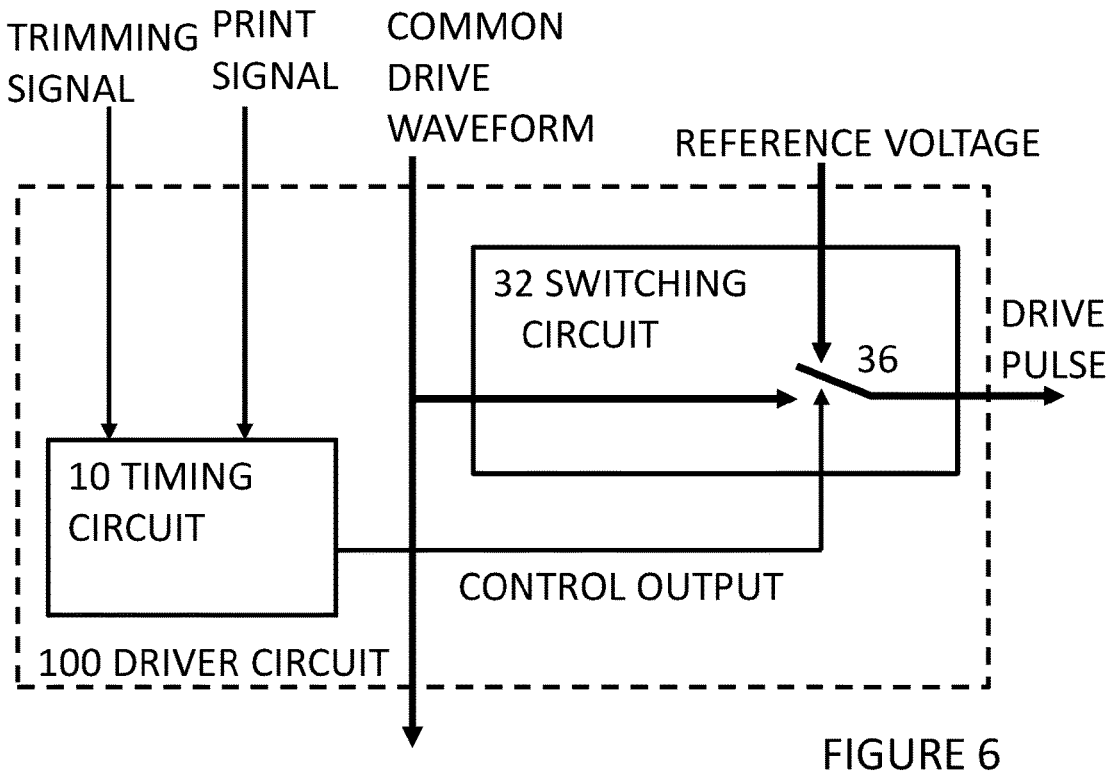
FIG. 6 shows a drive circuit according to an embodiment having coupling to a reference voltage.

FIG. 6 shows an embodiment of the drive circuit 100 in which there is a reference voltage and the switching circuit 32 has a switch 36 arranged to couple the actuator either to the common drive voltage as defined by the CDW or to the reference voltage. This is an example of the switching circuit also having a circuit to selectively couple the selected at least one of the actuators to a reference voltage, and the timing circuit 10 being arranged to control the duration $T_{TRIM}$ of the step by causing the switching circuit to couple the common drive voltage to the selected at least one of the actuators to provide a transition in the drive pulse, and to couple the reference voltage to the selected at least one of the actuators for a period of the drive pulse to provide a flat portion of the step. This is another way to implement the step in the drive pulse and can enable more precise levels in the drive pulse, but with more circuitry. The reference voltage can be set to the intermediate level or to another level beyond the range of voltages of the pulse in the CDW. The use of a reference voltage enables the drive pulse to have a flat portion at a level different to any intermediate level in the CDW. Also it enables the step to be formed on the trailing edge of the drive pulse or beyond the peak level of the CDW without needing a ledge in the CDW.

Figure 7:
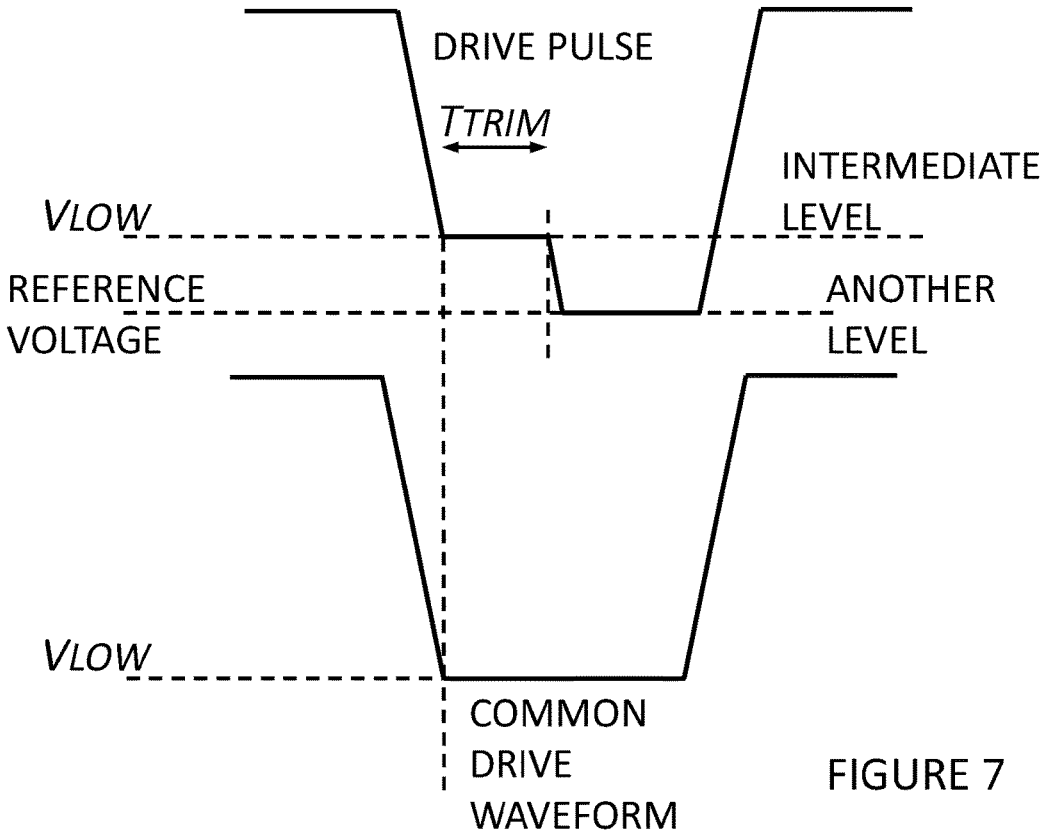
FIG. 7 shows a timing diagram corresponding to the circuit of FIG. 6.

FIG. 7 shows a timing diagram similar to that of FIGS. 2 and 3 for the circuit 100 of FIG. 6 for a case where there is no ledge in the CDW. The step is created in the drive pulse by decoupling the actuator from the CDW and coupling it to the reference voltage using the switching circuit 32 shown in FIG. 6. In FIG. 7 the reference voltage is below the level of $V_{LOW}$ of the CDW, and so $V_{LOW}$ is the intermediate level. It could be set to be above $V_{LOW}$ instead. The decoupling takes place part way along the bottom of the pulse at $V_{LOW}$ and creates the step in the drive pulse as shown. The timing of the decoupling sets the duration of the step $T_{TRIM}$ as shown. At the end of the flat portion of the pulse of the CDW, (or earlier, as desired), the recoupling takes place and the drive pulse returns to the level $V_{LOW}$ of the CDW, and then follows the trailing (and rising) edge of the pulse of the CDW. Optionally this coupling to and from the reference voltage can be combined with a pulse having a step as shown in other Figures, for example FIG. 10, 11 or 12, or with other features of embodiments.

Figure 8:
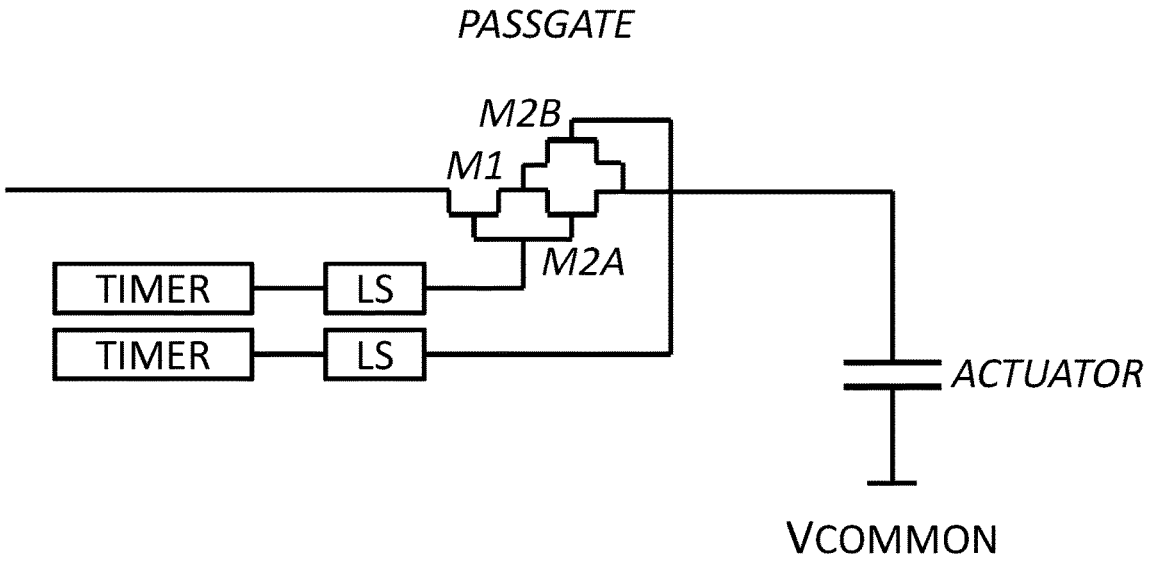
FIG. 8 shows a switching circuit according to an embodiment having slew rate control.
Figure 9:
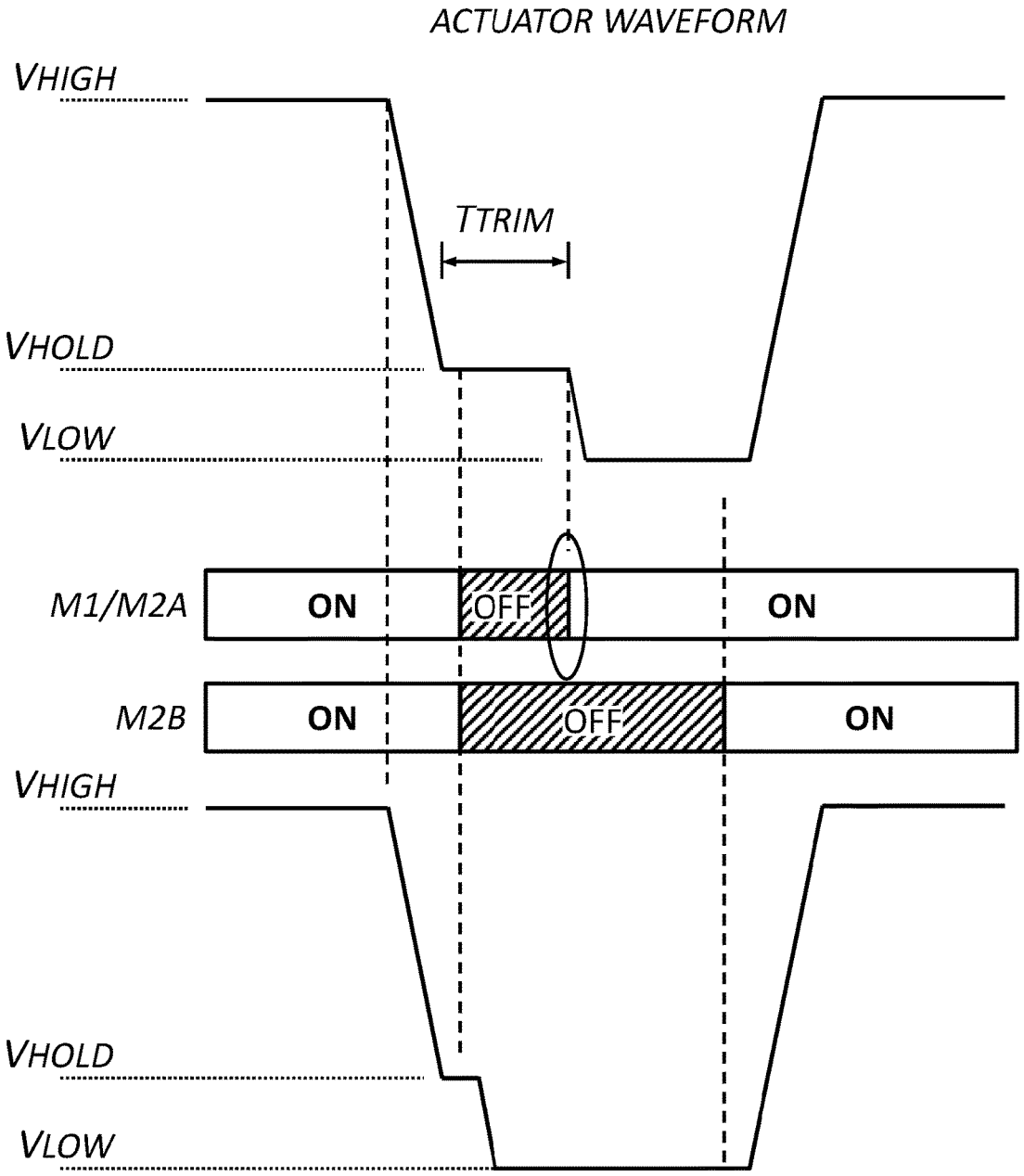
FIG. 9 shows a timing diagram corresponding to the circuit of FIG. 8, FIGS. 10, 11 and 12 show timing diagrams for alternative embodiments having different steps.

FIGS. 8, 9: Embodiment of Switching Circuit with Slew Rate Control

The simple implementation of the passgate in FIG. 5 has a possible disadvantage which is addressed now. The slew rates of the waveform transitions at the beginning and end of the drive pulse for causing the jetting operation (see e.g. FIG. 3) are controlled by the slew rates of the transitions of the CDW. The resistance of the passgate in the ON state is usually designed to minimise power dissipation in the ASIC and is a sufficiently low value so that the RC time constant of the passgate resistance and actuator capacitance does not reduce the slew rate of the waveform applied to the actuator. However, the slew rate of the actuator voltage transition from $V_{HOLD}$ to $V_{LOW}$ is not controlled by the CDW slew rate, and is limited only by the ON resistance of the passgate. Since this is low, then the slew of this transition can be much higher than the typical 100V/μs of the waveform generated by the CDW. The magnitude of the slew rate can result in a large current spike in the circuits handling the CDW and in ground connections which is not desirable. FIG. 8 shows a way of addressing this problem. Note that the actual gradients shown in the diagrams are not necessarily accurate representations.

FIG. 8 shows the implementation of a compound passgate 37. Here, the basic two transistor passgate is extended to three transistors: M1, M2A and M2B. M1 and M2B have a large Width/Length (W/L) ratio, designed to give a low ON resistance, while M2A has a small W/L ratio designed to give a higher ON resistance which will reduce the slew rate of the transition from $V_{HOLD}$ to $V_{LOW}$. M1 and M2A are controlled from one timer 11, and M2B is controlled from an independent second timer 12.

The operation is shown in FIG. 9 and is similar to that of FIG. 3 with the exception of the detail of the timing. FIG. 9 shows a timing diagram for a basic implementation of this slew controlled step-based trimming scheme. The CDW has a pulse which may have any shape, and is shown at the bottom of the diagram. The resulting drive pulse applied to the actuator is shown by the top line of the diagram. As in FIG. 3 there is the step in the leading edge of the actuator waveform: the step being at a voltage $V_{HOLD}$ and for a duration $T_{TRIM}$. Timing of the switching is indicated in the two horizontal bars in the middle of the diagram between the two waveforms, the top bar showing the state of M1/M2A, and the lower of the bars showing the state of M2B. Both bars show the ON state for the leading edge of the pulse in the CDW. This means that the ON resistance of the passgate is determined by M1 and M2B; both have a large W/L, as in FIG. 3, so the ON resistance of the passgate will be similar to that in FIG. 3. Next is an OFF section shown in hashing after the start of the flat portion of the ledge at the intermediate level in the CDW, during which the actuator is decoupled and so the step in the drive pulse is prolonged for a controlled duration $T_{TRIM}$ and does not follow the end of the ledge in the CDW.

The end of the step in the drive pulse is caused by recoupling after a controlled duration $T_{TRIM}$ using the switching circuit, and controlled by the timing circuit, and the drive pulse voltage drops from the intermediate level, $V_{HOLD}$, down to follow the voltage $V_{LOW}$ of the bottom of the pulse in the CDW. The $V_{HOLD}$ to Vow transition is enabled by turning ON only one half of the passgate, namely M1 and M2A. Since M2A has a smaller W/L (and hence higher ON resistance), the ON resistance of the passgate for this transition will be increased. This provides a facility for slowing the $V_{HOLD}$ to $V_{LOW}$ transition without compromising e.g. the $V_{HIGH}$ to $V_{HOLD}$ transition. The W/L of M2A can be set to give the required $V_{HOLD}$ to $V_{LOW}$ slew rate. The timing of the step duration $T_{TRIM}$, and hence the amount of trimming, is determined by the timing of when M1/M2A turn ON (the transition highlighted by the circle in FIG. 9). This is the same as for a standard passgate. Timing of the switching of M2B is not dependent on the step duration $T_{TRIM}$ and hence can be determined globally or per bank (rather than on a per-nozzle basis).

Note that this different slew rate should not affect the drop ejection as the ejection is typically only weakly dependent on the slew rate if the slew rate is above a threshold value. Note also that in the Figures, M2A and M2B are shown as separate MOS devices. In practice, these would likely be implemented as a single MOS device with multiple gate fingers, with one set of gate fingers driven by one timer, and the remaining gate fingers driven by the other timer. The number of gate fingers driven by each timer will determine the relative ON resistances of M2A and M2B.

This represents an example of the switching circuit being arranged to cause a transition in the step of the drive pulse where it does not follow the CDW, to have a different slew rate to that of a transition in the CDW. This can help reduce noise caused by excessive ground plane voltage movement due to higher current flowing during faster slew rates. FIG. 8 also represents an example of the switching circuit having at least two separately controllable switching paths having different series resistances, and the timing circuit being arranged to control the switching paths to provide a higher series resistance during the transition of e.g. recoupling the actuator back to the CDW. This is a convenient way of implementing different slew rates.

Figure 10:
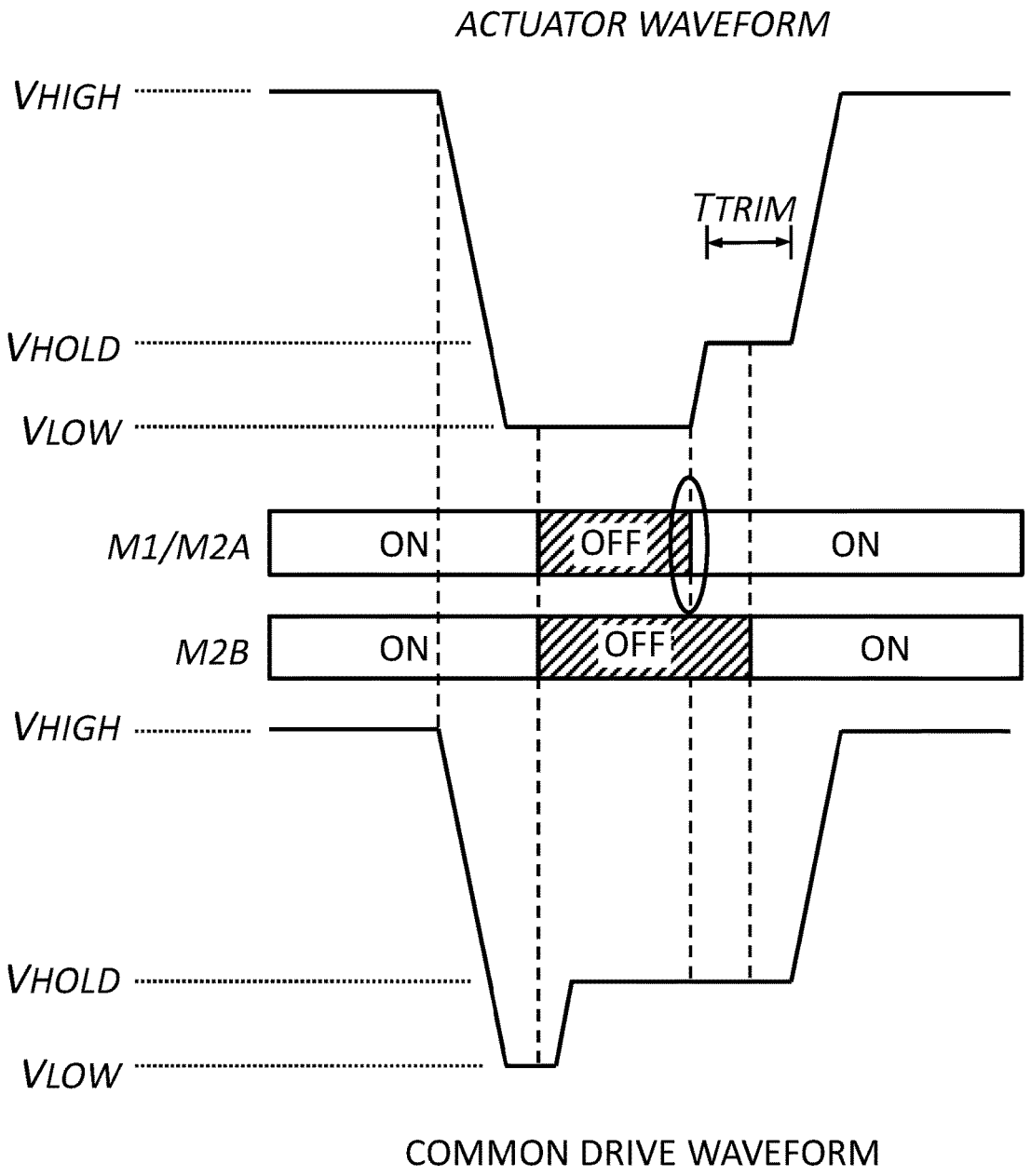
Figure 11:
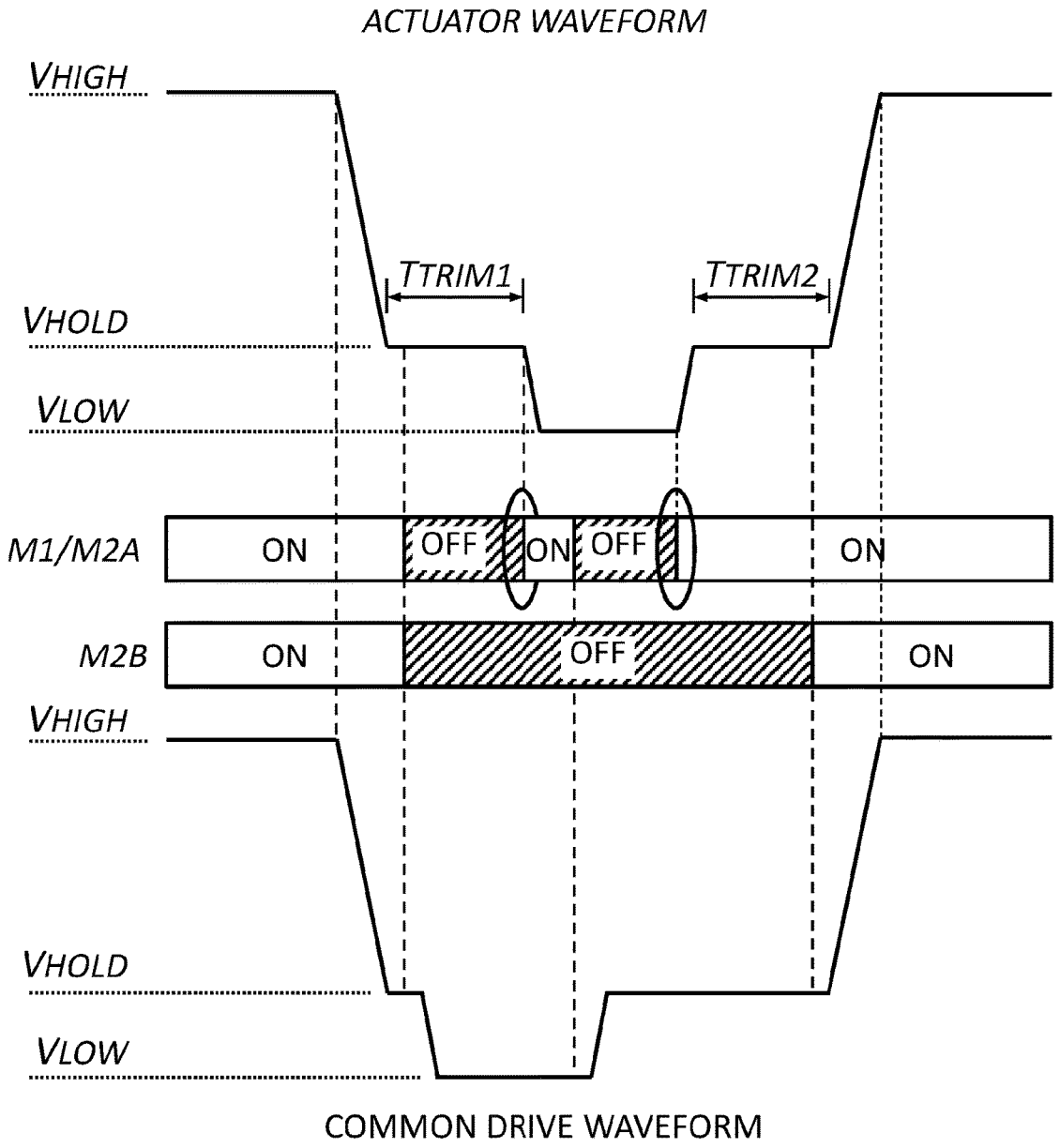
Figure 12:
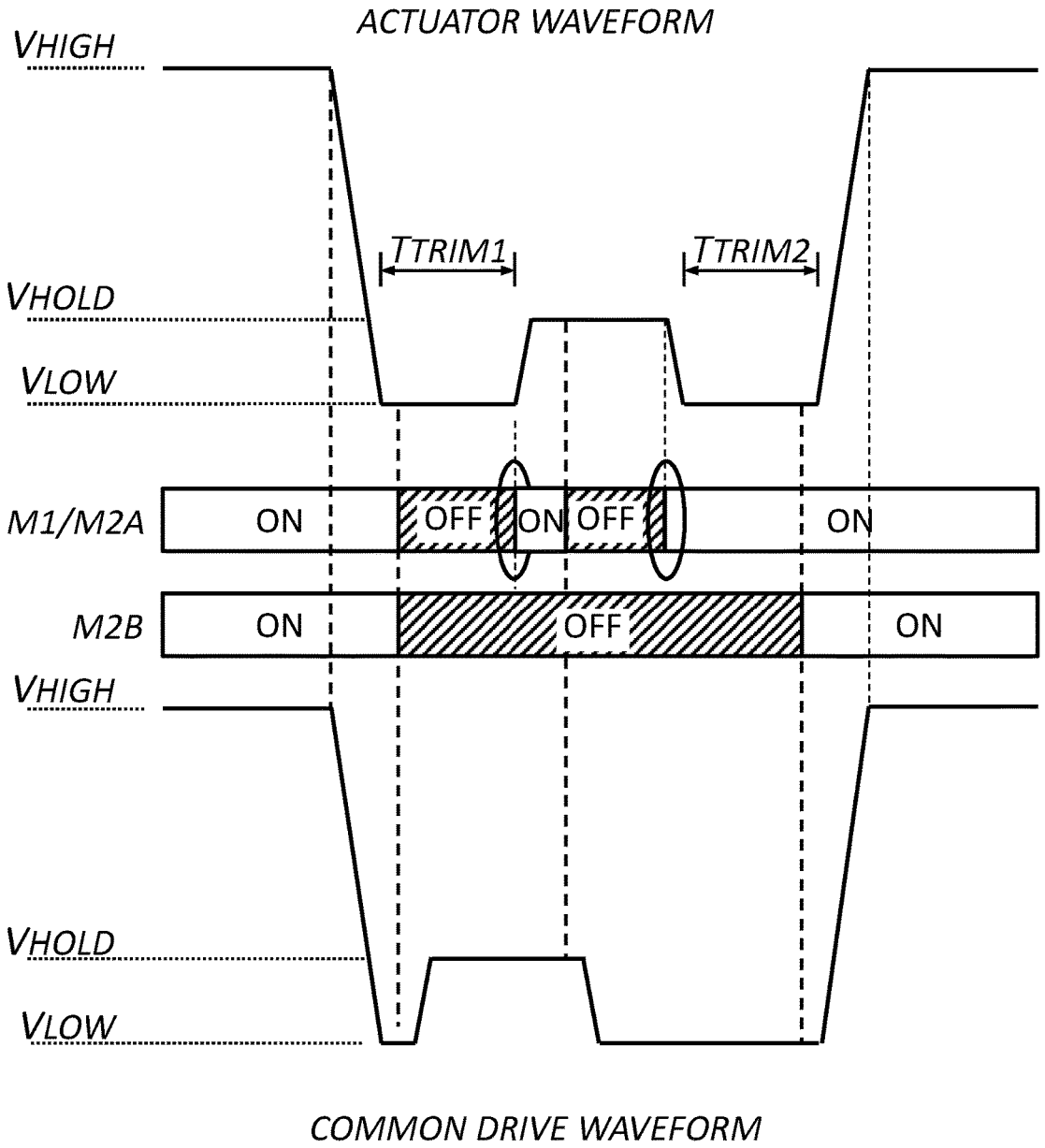

FIGS. 10-12: Other Types of Steps According to Embodiments

FIG. 10 shows a timing diagram similar to that of FIG. 9 but showing a variant in which the trimming step is located at the trailing edge of the jetting pulse, rather than at its leading edge. Locating the step at the trailing edge of the jetting pulse is realised by: (i) modifying the CDW, and (ii) modifying the timing of the passgate switching. It will be noted that, advantageously, this change does not require a circuit reconfiguration. This can be implemented with the slew rate controlled passgate or with other switching circuits. The CDW as shown has a flat portion along a ledge on the trailing edge and the step duration in the drive pulse is controlled by making it shorter, by decoupling before the start of the ledge and recoupling after the start of the ledge in the CDW. The recoupling defines the timing of the start of the step in the drive pulse. Another possible variant would be to couple to a reference voltage using the circuit of FIG. 6, in which case the start of the step in the drive pulse could occur before the start of the ledge in the CDW, and/or the step could have more than one level if the reference voltage is set to a different level than the $V_{HOLD}$ of the CDW.

This represents an example of the drive circuit being arranged so that where the CDW comprises a multilevel pulse having a portion at another (lower in FIG. 10) level before a portion at the intermediate level, the timing circuit is arranged to cause decoupling from the CDW to occur during the portion at the other level and to cause a recoupling to occur during the portion at the intermediate level to control the duration $T_{TRIM}$. This is another way of enabling the more relaxed timing, such as where the portion at the intermediate level is part of a trailing edge of the pulse, or a trailing edge of a secondary peak in the pulse. Notably the timing of the decoupling directly affects the pulse shape and so the precision of this timing affects the precision of the trimming. The timing of the recoupling does need not be so precise.

FIG. 11 shows a timing diagram similar to that of FIG. 9 but showing a variant in which there are trimming steps located on both leading and trailing edges. Thus the CDW has two ledges with flat portions at $V_{HOLD}$: one at the leading edge of the jetting waveform, and one at the trailing edge. As before, this can be implemented with the slew rate controlled passgate or with other switching circuits. The durations of the two steps in the actuator drive pulse are $T_{TRIM1}$ and $T_{TRIM2}$ respectively. Once again the trimming is determined by the timing of the passgate switching. However, in this implementation there are two timing events—again highlighted in circles, at the end of the leading edge step and the start of the trailing edge step. In this case the start of the leading edge step and the end of the trailing edge step involve switching during flat portions of the CDW and so less precise timing is needed. As before, the timing of M2B switching is independent of the amount of trimming required.

This shows another example of the drive circuit being arranged so that where the CDW comprises a multilevel pulse having a portion at the intermediate level before a portion at another level, the timing circuit is arranged to cause decoupling from the CDW to occur during the portion at the intermediate level and to cause a recoupling to occur during the portion at the another level, to control the duration of the step in the actuator drive pulse. This is one way of enabling the timing of one of the changes in coupling to be relaxed, by making it occur in a flat portion such as where the portion at the intermediate level is part of a leading edge of the pulse, or a leading edge of a secondary peak in the pulse. Notably the timing of the decoupling need not affect the shape and thus need not be so precise. The timing of the recoupling directly affects the pulse shape and so the precision of its timing affects the precision of trimming.

FIG. 12 shows a timing diagram similar to that of FIG. 11 but showing a variant in which there are two trimming steps but neither is located on leading or trailing edges, and the polarity of the steps is changed relative to the polarity of the pulse. Thus the voltage levels give a peak rather than a notch in the centre of the jetting pulse. This is achieved by changing the CDW so that the leading and trailing edges are not curtailed to form ledges, but instead there is a step up from $V_{LOW}$ and a subsequent step down at some point within the bottom level of the CDW. Timing details are the same as for FIG. 11, the timings of the step up and the step down being delayed by a controllable time to provide the control of durations $T_{TRIM1}$ and $T_{TRIM2}$ of the First and Second step in the drive pulse to provide the trim effect. To increase the drop velocity, the first step (up) may have more delay and the second step (down) have less delay (i.e. $T_{TRIM}1$>duration at $V_{HOLD}$).

Figure 13:
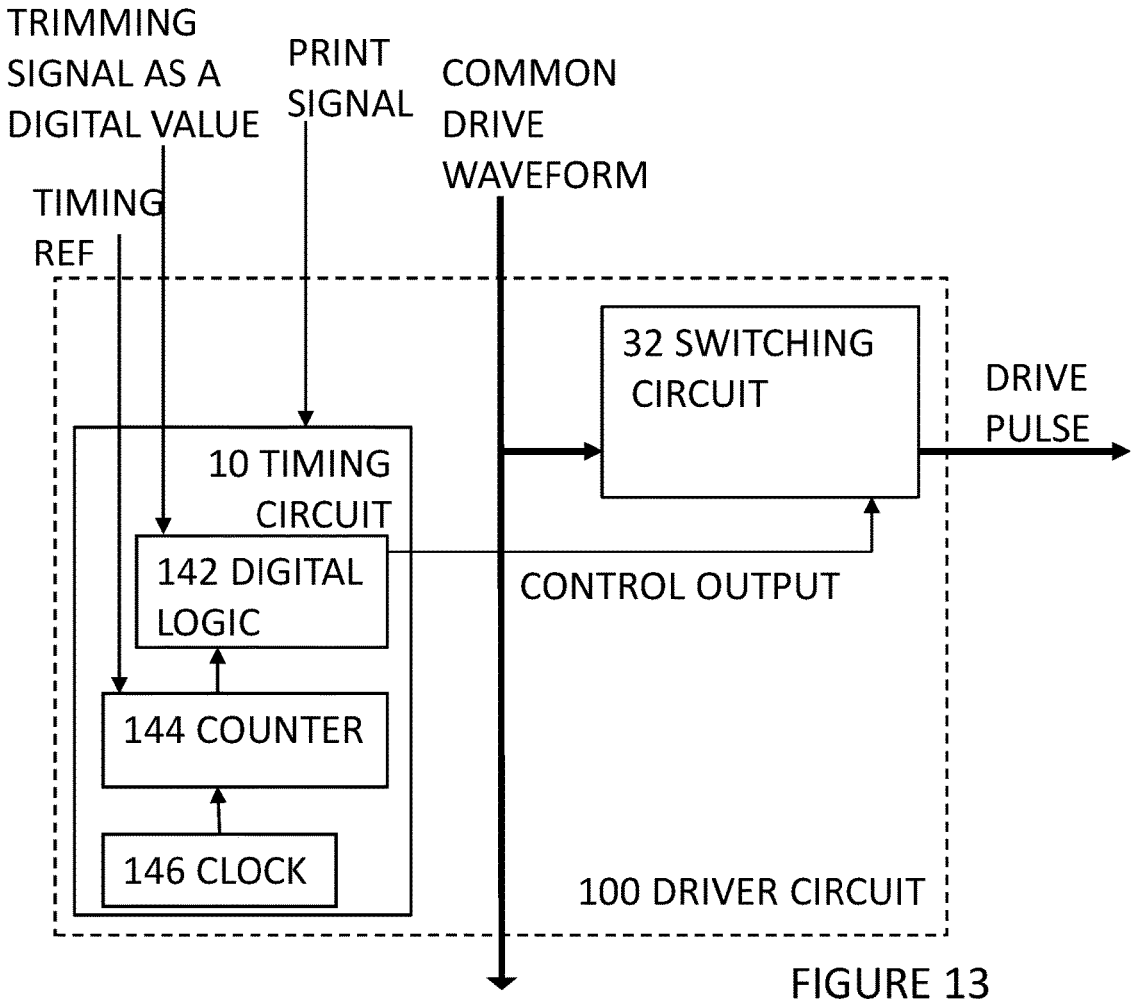
FIG. 13 shows a drive circuit according to an embodiment having digital circuitry for timing.

FIG. 13: Digital Timing Circuit Embodiment

FIG. 13 shows a schematic view of a drive circuit 100 similar to that of FIG. 1 and showing the timing circuit 10 for generating the control output in the form of ON and OFF signals for the switching circuit 32, having timings as shown for example in the timing diagrams described above. It can be implemented for example as having a counter 144, clock 146, and digital logic circuitry 142. The counter 144 is clocked by a clock 146. The digital logic circuit is arranged to receive a trimming signal value as one or more digital values and compare it or them with a digital output of the counter 144. The counter can be started by a timing reference signal either generated from the CDW or received from external circuitry such as the common circuitry described below with reference to FIG. 17. When the counter value matches the trimming signal values, the digital logic changes its state and gates the result with the print signal to generate the control output. The counter can be reset before each pulse. The digital logic may for example use a stored value for a start of the step and use a received value for the end of the step. The trimming signal value may have a number of bits according to how much trim resolution is desired. A total of 6 bits for example would allow 64 different amounts of trimming. A further degree of control is optionally provided by varying the frequency of the clock 146 that drives the counter 144. A higher frequency can provide a finer resolution, but reduced range of trimming. Many different ways of implementing suitable digital timing and logic can be envisaged. For example it can provide multiple control output signals to suit more complex switching circuits, or different versions for different shapes or timings of CDW pulses.

FIG. 13 represents an example of the timing circuit being arranged to receive a reference timing signal, and to receive the trimming signal as a digital value corresponding to a time interval between the reference timing signal and a desired timing of the step, and having a digital circuit for using the digital value and the reference timing signal to generate the control output. This is a way of implementing the synchronising so as to keep the amount of circuitry, and its cost and thermal effects, low.

The reference timing signal can be a global reference for all actuators, or specific to one of a number of banks of actuators, or specific to each of the actuators for example. It should have some defined relation to the timing of whatever part of the pulse in the CDW represents one end of (or some other given point along) the step, so that the duration of the step can be defined relative to this reference timing signal. There are various ways of achieving this, for example the reference timing signal could be derived directly from that given end or point along the step, or it could be derived indirectly, from some other timing signal which has itself been derived from that given end or point along the step. Or the reference timing signal could be derived indirectly in the sense of being derived from a common timing source down a different branch of a timing hierarchy or tree to a branch used to derive the pulse in the CDW for example. So the trimming signal could be for example a digital value of a number of clock pulses starting from a change of state of the print signal, or from a change of state of the control output where it decouples the drive pulse from the CDW for example.

Figure 14:
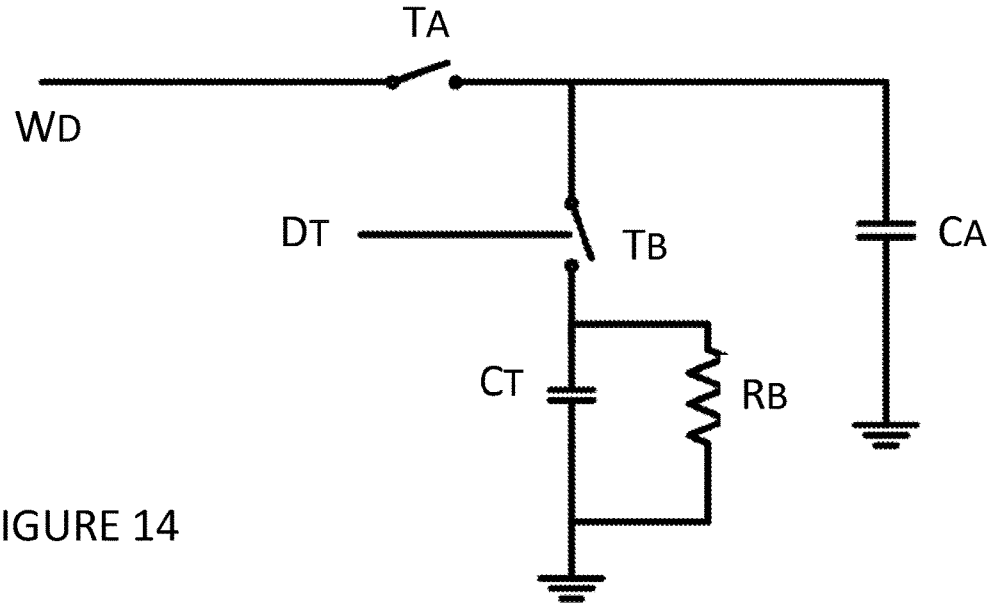
FIGS. 14, 15 and 15A show examples of switching circuits for drive circuits according to embodiments having holding circuits for creating steps.
Figure 15:
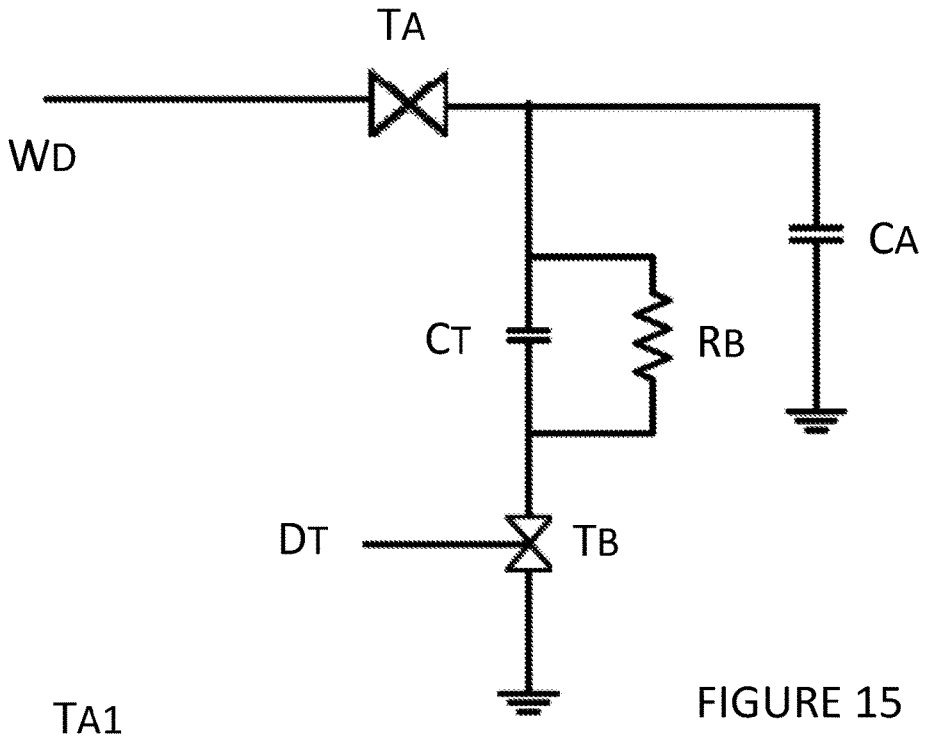
Figure 15A:
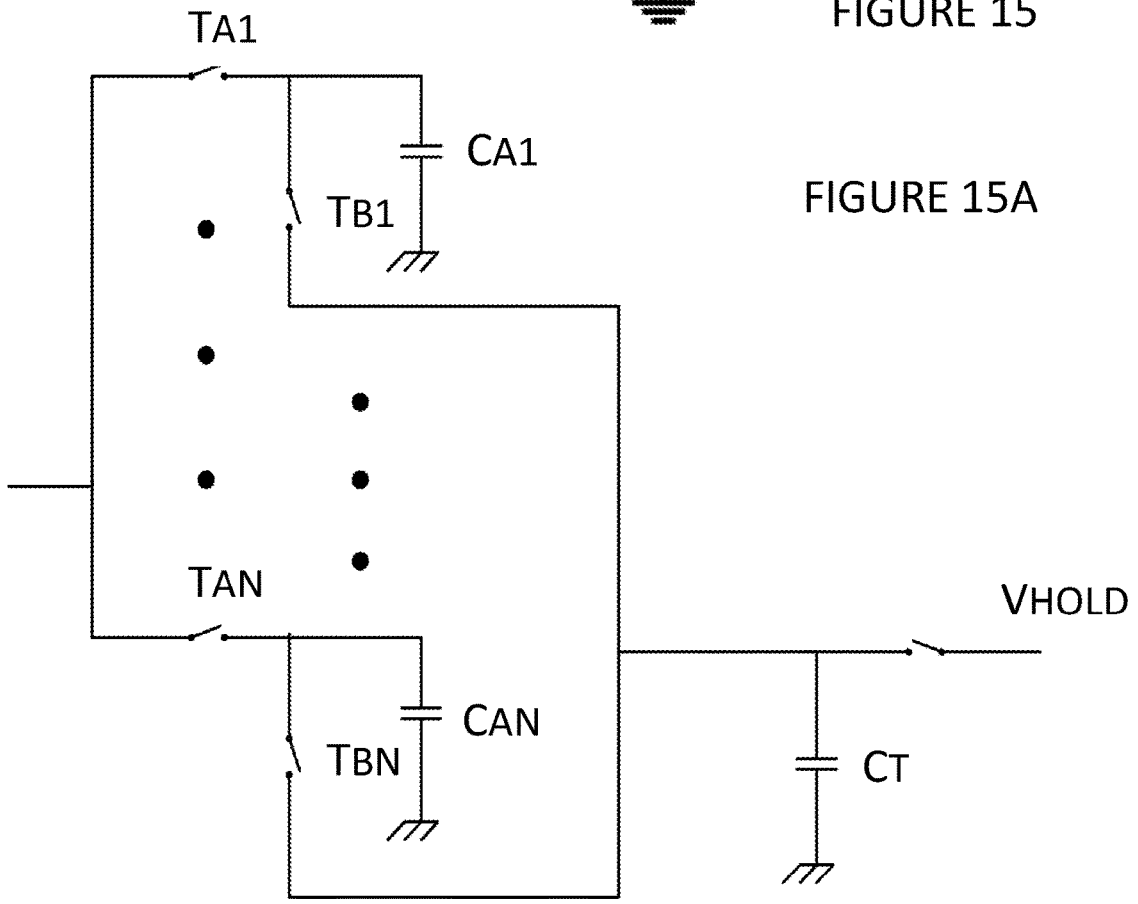
Figure 16:
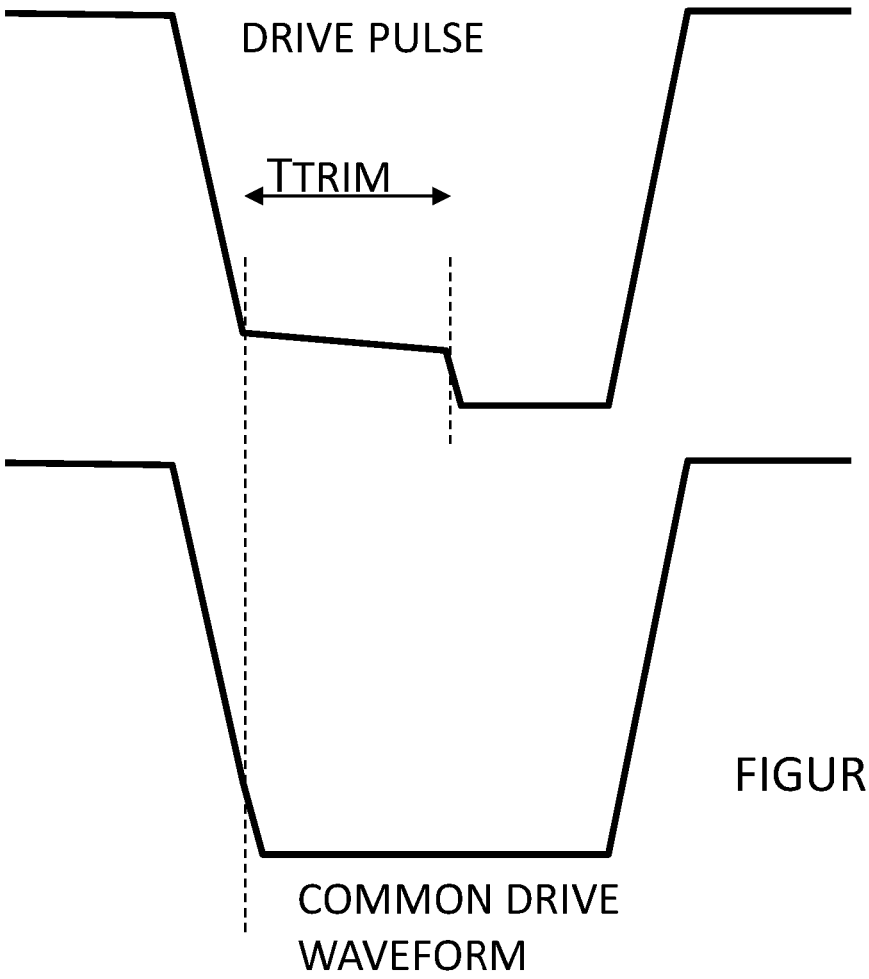
FIG. 16 shows a timing diagram corresponding to the circuit of FIGS. 14 and 15.

FIGS. 14 to 16: Embodiments Having a Holding Circuit for Creating a Step without Isolating the Actuator Examples of alternative switching circuits are shown in FIGS. 14, 15 and 15A. These can be used to implement step based trimming without needing a ledge in the pulse of the CDW. The circuit In each case operates to decouple the drive pulse from the CDW without isolating it. FIG. 14 shows a relatively simple implementation for explaining the working of the trimming technique. The actuator being driven is represented as the load capacitor $C_A$, and is coupled to the CDW by a switch $T_A$. Following a cold switching technique, the switch $T_A$ is switched ON when the actuator needs to be driven. The switching circuit also includes a holding circuit 148 having a holding switch $T_B$, for use in trimming, for creating a step of controllable duration, controlled by the control output of a timing circuit as described above for other embodiments. The holding circuit 148 has a holding capacitor $C_T$ and a bleed resistor $R_B$. When the holding switch $T_B$ is switched ON during the leading edge of the pulse in the CDW, a step of duration $T_{TRIM}$ in the drive pulse waveform as shown in FIG. 16 is created. FIG. 16 shows a timing diagram similar to that of FIG. 3 or FIG. 7, to show the operation of the embodiments of FIGS. 14 and 15 and to show a drive pulse having a step having a shallow gradient created by decoupling during the slope of the leading edge of the pulse of the CDW. The small gradient in the flat portion of the step is caused by a small residual current flowing to the actuator.

When the holding capacitor $C_T$ is switched in, the voltage of the drive pulse is held nearly constant and no longer follows the leading edge of the CDW. When the holding capacitor $C_T$ is decoupled, the drive pulse voltage rapidly drops back to the voltage $V_{LOW}$ of the CDW and so the step ends. The duration of the step is determined by how long $T_B$ is in the ON state. The step is created in the waveform due to the fact that the current through switch $T_A$ is now split between the actuator ($C_A$) and the trimming circuit ($C_T$ and $R_B$). Based on the time instance and the duration for which $T_B$ is switched ON the drop velocity can be trimmed. The height of the step is sensitive to the timing of the switching operation.

FIG. 15 shows a similar circuit to that of FIG. 14 and where the transmission gate $T_B$ has been moved to the other side of the holding capacitor $C_T$. This means the gate input of $T_B$ can be driven by a lower voltage signal thereby avoiding the need for voltage translation. The holding capacitor in both of these embodiments needs to be large enough to take a considerable current, which in some cases may imply a cost in terms of silicon area or circuit board area. Another alternative holding circuit (not shown) is to provide a circuit instead to control an equivalent current to achieve a similar effect to the holding capacitor. This can be implemented in various ways, for example using a current mirror and analog switches. In this case the split of the current between the actuator and trimming circuit can be controlled better at the cost of slightly more circuitry. The mechanism can also be applied to the trailing edge of the waveform independently of the modifications applied to the leading edge. The CDW is assumed to come from a voltage amplifier.

FIG. 15A shows a variant of FIG. 14 in which the holding capacitor is shared between a number of actuators. This can help address the issue of cost in terms of silicon area or circuit area, particularly where there are a large number of actuators. In FIG. 15A there are a number of actuators each represented by a load capacitor $C_{A1}$-$C_{AN}$, and each has a corresponding switch $T_{A1}$-$T_{AN}$, for selective coupling to the CDW. Each load capacitor also has its own holding circuit having a holding switch $T_{B1}$-$T_{BN}$ to couple the holding capacitor to the actuator side of the respective one of the switches $T_{A1}$-$T_{AN}$. All of (or at least two of) these holding circuits share the same holding capacitor $C_T$, since one side of this holding capacitor is coupled to one side of the switches $T_{B1}$-$T_{BN}$, and the other side of the holding capacitor is coupled to ground or some other voltage level. As in FIG. 14, the holding circuit can be switched ON for part of the pulse in the CDW to hold the voltage at a level away from the CDW, so as to create a step in the drive pulse of controllable duration. Optionally, a switched charging path is provided if needed to periodically charge the holding capacitor $C_T$ by coupling it to a voltage supply at $V_{HOLD}$ as shown.

These FIGS. 14, 15, and 15A represent examples of the drive circuit being arranged such that when the CDW has no ledge at the intermediate level, the timing circuit is arranged to change the switching circuit as the CDW passes through the intermediate level, as shown by example in FIG. 16. This enables operation where there is no ledge in the CDW, and can be implemented on either a leading edge or a trailing edge of the pulse of the CDW. These Figures also represent examples of the switching circuit having a holding circuit for maintaining a level in the drive pulse without isolating it from the CDW. This is another way of implementing the step in the drive pulse and controlling its timing.

Figure 17:
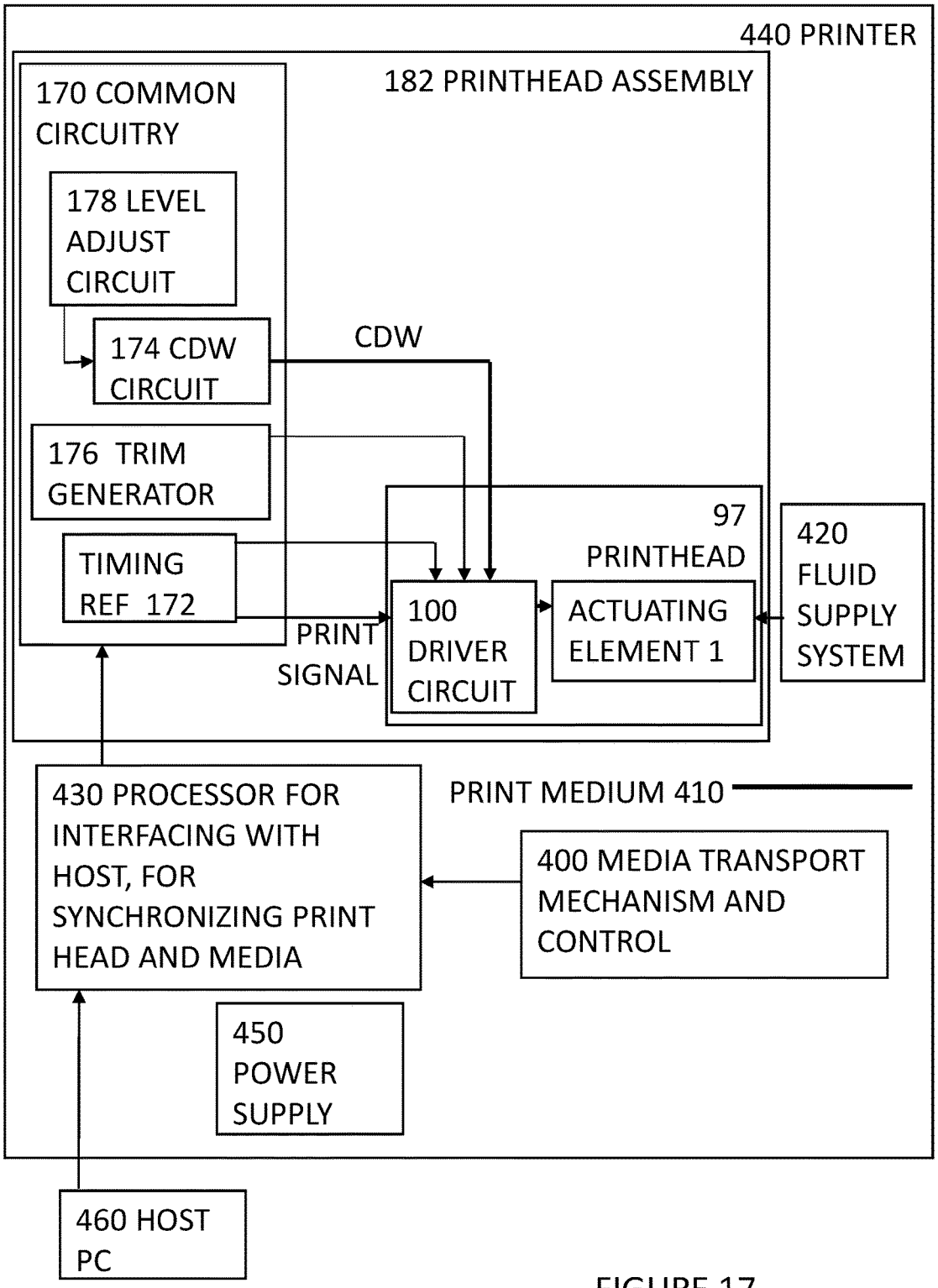
FIG. 17 shows a printer having a printhead assembly according to an embodiment.

FIG. 17: Embodiment Showing Printer Features

The printhead arrangements described above can be used in various types of printer. Two notable types of printer are:

(a) a page-wide printer (where printheads e.g. mounted on a static printbar cover the entire width of the print medium, with the print medium (tiles, paper, fabric, or other) passing under the printheads), and (b) a scanning printer (where one or more printheads e.g. mounted on a printbar move back and forth over the medium, whilst the print medium advances in increments under the printheads, and is stationary whilst the printheads scan across). There can be large numbers of printheads moving back and forth in this type of arrangement, for example 16 or 32, or other numbers.

In both types of printer, the printheads can optionally be operating several different colours, plus perhaps primers and fixatives or other special treatments. Other types of printer can include 3D printers for printing fluids such as plastics or other materials in successive layers to create solid objects.

FIG. 17 shows a schematic view of a printer 440 coupled to a source of data for printing, such as a host PC 460. There is a printhead assembly 182 which has common circuitry 170 and one of more printheads 97. Each printhead has one or more actuators 1 and a corresponding drive circuit 100 addressing the one or more actuators. The common circuitry 170 is coupled to the printhead 97, and coupled to a processor 430 for interfacing with the host 460, and for synchronizing the drive of actuators and location of the print media. This processor is coupled to receive data from the host, and is coupled to the printhead assembly to provide image data and signals for synchronizing with movement of the print medium at least. The processor can be used for overall control of the printer systems. This may therefore co-ordinate the actions of each subsystem within the printer so as to ensure its proper functioning.

The printer also has a fluid supply system 420 coupled to the nozzles, and a media transport mechanism and control part 400, for locating the print medium 410 relative to the nozzles. This can include any mechanism for moving the nozzles, such as a movable printbar. Again this part can be coupled to the processor to pass synchronizing signals and for example position sensing information. A power supply 450 is also shown.

The common circuitry 170 in this case has a CDW circuit 174 for generating the CDW, typically with a power amplifier to handle the currents needed if there are many actuators to be driven. Optionally the CDW circuit is coupled to a level adjust circuit 178 for adjusting the intermediate level, either based on the trimming signal or a different global or per nozzle trim signal. There is a trim generator 176 for generating the trimming signals, which are fed to each drive circuit, optionally as digital values, updated as often as needed. There may be a static part and a dynamic part of the trimming signal for each drive circuit, representing time invariant and time varying differences between the actuators. The common circuitry also has a timing reference circuit 172, for generating a timing reference for use by the timing circuits of the drive circuits. In principle this may not be necessary if the timing could be obtained from the CDW by the timing circuit in each drive circuit, though in practice the higher currents and noise in the CDW may make it less useful for synchronising the timings of the switching.

This Figure shows an example of a printhead assembly having at least one drive circuit for driving at least one of a plurality of actuators of a print head from a common drive waveform, and a common drive waveform circuit for generating the common drive waveform with a pulse having a flat portion. The drive circuit has a switching circuit for coupling the common drive waveform to provide a drive pulse to a selected at least one of the actuators, and a timing circuit coupled to receive a trimming signal and having a control output coupled to control the switching circuit so as to form the drive pulse from at least part of the pulse in the common drive waveform, and so as to trim the drive pulse by controlling according to the trimming signal a duration of a step in the drive pulse, by changing a state of the switching circuit during the flat portion in the common drive waveform. This Figure also represents an example of the common drive waveform circuit having a level adjustment circuit for adjusting the intermediate level. This can enable adjustment of the range and resolution of the trimming.

Other embodiments and variations can be envisaged within the scope of the claims.

The invention claimed is:

1. A drive circuit for driving at least one of a plurality of actuators of a printhead from a common drive waveform, the drive circuit comprising:

a switching circuit for coupling the common drive waveform to provide a drive pulse to a selected at least one of the actuators, wherein the drive pulse has one or more steps that each correspond to a respective level of the drive pulse, and a timing circuit coupled to receive a trimming signal and a print signal and having a control output coupled to control the switching circuit so as to form the drive pulse from at least part of a pulse in the common drive waveform, wherein:

the timing circuit controls the switching circuit such that the switching circuit trims the generated drive pulse by controlling, according to the trimming signal, a duration of a step corresponding to an intermediate level in the drive pulse, the timing circuit is configured to receive a reference timing signal, and to receive the trimming signal as a digital value corresponding to a time interval between the reference timing signal and a desired timing of the step, and the timing circuit comprises a digital circuit for using the digital value and the reference timing signal to generate the control output.

2. The drive circuit of claim 1, wherein the timing circuit is configured to control the duration by causing the switching circuit to:

couple the common drive waveform to the selected at least one of the actuators to provide a transition in the drive pulse, decouple the common drive waveform from the selected at least one of the actuators to provide a flat portion of the step in the drive pulse, and recouple the common drive waveform to the selected at least one of the actuators to provide another transition in the drive pulse.

3. The drive circuit of claim 1, wherein:

the switching circuit comprises a circuit to selectively couple the selected at least one of the actuators to a reference voltage, the timing circuit is configured to control the duration by causing the switching circuit to:

couple the common drive waveform to the selected at least one of the actuators to provide a transition in the drive pulse, and couple the reference voltage to the selected at least one of the actuators for a period in the drive pulse to provide a flat portion of the step.

4. The drive circuit of claim 1, wherein the timing circuit is configured to control the duration of the step independently of control of a height of the step.

5. The drive circuit of claim 1, wherein the timing circuit is configured to cause the switching circuit to decouple the common drive waveform during a flat portion of the common drive waveform.

6. The drive circuit of claim 1, wherein the common drive waveform comprises a multilevel pulse having a portion at another level before a portion at the intermediate level, the switching circuit is configured to receive a timing signal from the timing circuit to decouple the common drive waveform during the portion at the another level and to recouple the common drive waveform during the portion at the intermediate level to control the duration of the step.

7. The drive circuit of claim 1, wherein the switching circuit is arranged to:

cause a transition in the step of the drive pulse where it does not follow the common drive waveform and that has a different slew rate than that of a transition in the common drive waveform.

8. The drive circuit of claim 7, wherein:

the switching circuit comprises at least two separately controllable switching paths having different series resistances, and the timing circuit is arranged to control the switching paths to provide a higher series resistance during the transition in the step of the drive pulse where it does not follow the common drive waveform.

9. The drive circuit of claim 1, wherein the timing circuit is configured, when the common drive waveform has no ledge at the intermediate level, to change the switching circuit as the common drive waveform passes through the intermediate level.

10. A printhead assembly having at least one drive circuit for driving at least one of a plurality of actuators of a printhead from a common drive waveform, and a common drive waveform circuit for generating the common drive waveform with a pulse having a flat portion, and the drive circuit comprising:

a switching circuit for coupling the common drive waveform to provide a drive pulse to a selected at least one of the actuators, and a timing circuit coupled to receive a trimming signal and having a control output coupled to control the switching circuit so as to form the drive pulse from at least part of a pulse in the common drive waveform, and so as to trim the drive pulse by controlling according to the trimming signal a duration of a step at an intermediate level in the drive pulse, wherein:

the timing circuit is configured to receive a reference timing signal, and to receive the trimming signal as a digital value corresponding to a time interval between the reference timing signal and a desired timing of the step, and the timing circuit comprises a digital circuit for using the digital value and the reference timing signal to generate the control output.

11. The printhead assembly of claim 10, wherein the common drive waveform circuit comprises a level adjustment circuit for adjusting the intermediate level.

12. A method of operating a printhead having a plurality of actuators, the method comprising:

using a switching circuit to couple a common drive waveform having a pulse to a selected at least one of the actuators to provide a drive pulse;

generating a trimming signal;

receiving, by a timing circuit, the trimming signal and a print signal; and controlling, by the timing circuit, the switching circuit to form the drive pulse from at least part of a pulse in the common drive waveform and trimming the drive pulse by controlling, according to the trimming signal, a duration of at least one of:

a duration of a step at an intermediate level in the drive pulse; and a timing of a step up from a low level and a timing of a subsequent step down to the low level at some point within a bottom level of the common drive waveform wherein:

the timing circuit is further configured to receive a reference timing signal, and to receive the trimming signal as a digital value corresponding to a time interval between the reference timing signal and a desired timing of the step, and the timing circuit comprises a digital circuit for using the digital value and the reference timing signal to generate the control output.

13. The method of claim 12, wherein the timings of the step up and the subsequent step down are delayed by a controllable time to provide control of durations of first and second steps at a low level in the drive pulse.

14. The method of claim 12, wherein the timing circuit is configured to:

control the duration by controlling the switching circuit:

to couple the common drive waveform to the selected at least one of the actuators to provide a transition in the drive pulse;

to decouple the common drive waveform from the selected at least one of the actuators for a period to provide a flat portion in the drive pulse; and to recouple the common drive waveform to the selected at least one of the actuators to provide another transition in the drive pulse.

15. The method of claim 12, wherein the common drive waveform comprises a multilevel pulse having a portion at another level before a portion at an intermediate level of the common drive waveform, the timing circuit is configured to decouple the common drive waveform during the portion at the another level and to recouple the common drive waveform during the portion at the intermediate level of the common drive waveform to control the duration of the step.

16. The method of claim 12, wherein the timing circuit is configured to control the switching circuit to decouple the common drive waveform during a flat portion of the common drive waveform.

17. The method of claim 12, wherein:

the switching circuit comprises a circuit to selectively couple the selected at least one of the actuators to a reference voltage; and the timing circuit is configured to:

control the duration by controlling the switching circuit to couple the common drive waveform to the selected at least one of the actuators to provide a transition in the drive pulse, and couple the reference voltage to the selected at least one of the actuators for a period in the drive pulse to provide a flat portion of the step in the drive pulse.

* * * * *